US008963408B2

(12) United States Patent
Shibata et al.

(10) Patent No.: US 8,963,408 B2
(45) Date of Patent: Feb. 24, 2015

(54) SPARK PLUG FOR INTERNAL COMBUSTION ENGINES

(71) Applicant: Denso Corporation, Kariya (JP)

(72) Inventors: Masamichi Shibata, Toyoto (JP); Takayuki Inohara, Okazaki (JP); Shinichi Okabe, Aichi (JP); Takanobu Aochi, Nishio (JP); Kaori Doi, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 14/101,386

(22) Filed: Dec. 10, 2013

(65) Prior Publication Data

US 2014/0159563 A1 Jun. 12, 2014

(30) Foreign Application Priority Data

Dec. 10, 2012 (JP) ..... 2012-269106

(51) Int. Cl.
*H01T 13/20* (2006.01)
*H01T 13/02* (2006.01)

(52) U.S. Cl.
CPC ..... *H01T 13/02* (2013.01)
USPC ..... 313/141

(58) Field of Classification Search
CPC ..... H01T 13/32; H01T 13/20
See application file for complete search history.

(56) References Cited

U.S. PATENT DOCUMENTS

| | | | | |
|---|---|---|---|---|
| 6,060,822 | A * | 5/2000 | Krupa et al. | 313/141 |
| 6,583,539 | B1 * | 6/2003 | Zamora | 313/143 |
| 2005/0057132 | A1 * | 3/2005 | Cleeves | 313/141 |
| 2010/0320894 | A1 * | 12/2010 | Hartmann et al. | 313/142 |
| 2012/0299459 | A1 * | 11/2012 | Sakakura et al. | 313/141 |
| 2013/0015755 | A1 | 1/2013 | Inohara et al. | |
| 2013/0229102 | A1 * | 9/2013 | Raasch et al. | 313/11.5 |

FOREIGN PATENT DOCUMENTS

| | | |
|---|---|---|
| JP | 9-148045 | 6/1997 |
| JP | 2013-038063 | 2/2013 |

* cited by examiner

*Primary Examiner* — Donald Raleigh
(74) *Attorney, Agent, or Firm* — Nixon & Vanderhye P.C.

(57) ABSTRACT

A spark plug for internal combustion engines is provided, where the spark plug includes a cylindrical housing, a cylindrical insulation porcelain part, a center electrode, and a ground electrode. The insulation porcelain is housed in the housing and the center electrode is held inside the insulation porcelain. The ground electrode protrudes from a top end portion of the housing. A spark discharge gap is left between the ground and center electrodes. Further, first to third projections are formed on the top end portion. The first projection is opposed to the ground electrode with the center electrode therebetween. The second projection is closer to the ground electrode than to the first projection. The third projection is closer to the first projection than to the ground electrode.

20 Claims, 17 Drawing Sheets

SPARK PLUG FOR INTERNAL COMBUSTION ENGINES

CROSS-REFERENCE TO RELATED APPLICATION

This application is based on and claims the benefit of priority from earlier Japanese Patent Application No. 2012-269106 filed Dec. 10, 2012, the description of which is incorporated herein by reference.

BACKGROUND OF THE INVENTION

1. Technical Field of the Invention

The present invention relates to a spark plug for internal combustion engines which are mounted in structures such as vehicles.

2. Related Art

Spark plugs are used as igniting means in internal combustion engines, such as the engines for vehicles. Some of such spark plugs have a configuration in which a center electrode is permitted to axially face a ground electrode to form a spark discharge gap therebetween. This type of spark plug causes discharge in the spark discharge gap to use the discharge for the ignition of the air-fuel mixture in the combustion chamber.

In the combustion chamber, a flow of the air-fuel mixture, such as a swirl flow or a tumble flow, is formed. The flow is appropriately directed to the spark discharge gap as well to ensure ignitability.

However, depending on the mounting posture of a spark plug with respect to the internal combustion engine, a part of the ground electrode connected to a top end portion of a housing may be located upstream of the spark discharge gap. In this case, the flow in the internal combustion engine may be blocked by the ground electrode to stagnate the flow in the vicinity of the spark discharge gap. As a result, the ignitability of the spark plug may be impaired. In other words, depending on the mounting posture of the spark plug with respect to the internal combustion engine, the ignitability of the spark plug may be problematically varied. In recent years, in particular, there is a trend of using lean-burn internal combustion engines. In such an internal combustion engine, combustion stability may be impaired depending on the mounting posture of the spark plug.

Further, it is difficult to control the mounting posture of the spark plug with respect to the internal combustion engine, i.e. to control the position of the ground electrode in the circumferential direction of the spark plug. This is because the mounting posture of the spark plug is unavoidably varied, depending such as on the state of the mounting screws formed in the housing, or the degree of tightening the spark plug in the work of mounting the spark plug on the internal combustion engine.

In order to suppress the airflow from being blocked by the ground electrode, a patent document JP-A-H09-148045 discloses a configuration in which the ground electrode is drilled to form a hole therein, or a configuration in which the ground electrode is joined to the housing using a plurality of thin-plate members.

However, the "configuration in which the ground electrode is drilled to form a hole therein" as disclosed in the patent document JP-A-H09-148045 may weaken the strength of the ground electrode. If the ground electrode is thickened to recover the weakened strength, the thickened ground electrode after all may tend to block the flow of the air-fuel mixture.

Further, the "configuration in which the ground electrode is joined to the housing using a plurality of thin-plate members" as disclosed in the patent document JP-A-H09-148045 may complicate the shape of the ground electrode and the number of manufacturing steps may be increased, leading to the problem of increasing the manufacturing cost.

SUMMARY

Hence it is desired to provide a spark plug for an internal combustion engine, which is able to ensure stable ignitability irrespective of its mounting posture with respect to the internal combustion engine.

In the disclosure, there is provided a spark plug for internal combustion engines, comprising: a cylindrical housing formed to have a top end portion, wherein the housing has a length-wise direction defined as an axial direction, a circumferential direction, a radial direction, and the housing has a tip-end side and a base-end side in the axial direction; a cylindrical insulation porcelain held inside the housing; a center electrode formed to have a top end portion and held inside the insulation porcelain such that the top end portion protrudes from the insulation porcelain; a ground electrode which protrudes from the top end portion of the housing such that there is left a spark discharge gap between the ground electrode and the center electrode; a first projection which projects from a first position on the top end portion of the housing to the tip-end side, the first position being set to be opposed to the ground electrode with the center electrode therebetween, a second projection which projects from a second position on the top end portion of the housing to the tip-end side, the second position being closer to the ground electrode than to the first projection, and a third projection which projects from a third position on the top end portion of the housing to the tip-end side, the third position being closer to the first projection than to the ground electrode.

The foregoing spark plug includes the first projection, the second projection and the third projection. Thus, in whatever posture the spark plug may be mounted with respect to the internal combustion engine, the airflow (flow of air-fuel mixture) in the combustion chamber directed to the spark discharge gap is prevented from being blocked.

Specifically, for example, when a part of the ground electrode is located upstream of the spark discharge gap, the airflow that has passed by the side of the ground electrode from the upstream side is directed to the spark discharge gap by the second projection. More specifically, the second projection functions as a guide for the airflow and directs the airflow to the spark discharge gap (this function is hereinafter referred to as "guiding function" as appropriate). Accordingly, the airflow in the vicinity of the spark discharge gap is prevented from being stagnated. As a result, stable ignitability is ensured in the spark plug.

Further, for example, when a part of the ground electrode is located downstream of the spark discharge gap, the first projection is located upstream of the spark discharge gap. In this case, the airflow that has passed by the side of the first projection from the upstream is directed to the spark discharge gap by the third projection. In other words, similar to the second projection, the third projection also exerts the guiding function.

In the absence of the first projection, when a part of the ground electrode is located downstream of the spark discharge gap, the airflow that passes through the spark discharge gap is likely to collide against the ground electrode. In this situation, the force of the airflow passing through the spark discharge gap tends to be weakened and the discharge spark is unlikely to be extended to a large extent. Therefore, when a part of the ground electrode is located downstream of the spark discharge gap, the ignitability is likely to be comparatively impaired.

In this regard, provision of the first projection as mentioned above can block the airflow that would directly flow toward the spark discharge gap from a directly opposite side of the ground electrode to thereby solve the foregoing problem (this function is hereinafter referred to "blocking function" as appropriate). As mentioned above, since the third projection can direct the airflow that has passed by the side of the first projection to the spark discharge gap, the force of the airflow passing through the spark discharge gap is ensured and the ignitability is also ensured.

The first projection, the second projection and the third projection can be realized with a simple configuration in which these projections are arranged being projected to the tip-end side from the top end portion of the housing. In other words, neither ingenuity is required in shaping the ground electrode, nor the ground electrode is required to be in a complicated shape.

As described above, according to the foregoing mode of the spark plug, a spark plug with a simple configuration can be provided, which is able to ensure stable ignitability irrespective of its mounting posture with respect to the internal combustion engine.

In the foregoing spark plug for an internal combustion engine, the direction in which the spark plug is inserted into the combustion chamber is referred to as "tip-end side", and the opposite direction is referred to as "base-end side".

It is preferred that the second and third projections are located only in half of an area of the top end portion of the housing, half of the area being half of an axial side area of the top end portion divided by a virtual line passing the ground electrode and the first projection. For example, the axial side area of the top end portion is an annular area of an axial side of the housing.

In this case, the configuration as provided below is reliably obtained, i.e. a configuration in which the airflow that has been directed to the spark discharge gap by the second projection (the third projection) can pass through the spark discharge gap without being blocked by the third projection (the second projection). Accordingly, the ignitability is easily enhanced.

It is also preferred that the second and third electrodes have tops whose protrusion heights from the top end portion are equal to or lower than a top of the ground electrode and are equal to or higher than a top of the insulation porcelain in the axial direction.

In this case, while ensuring the guiding function of the second and third projections, the size of the spark plug can be reduced in the axial direction. As a result, while the ignitability of the spark plug is ensured, the second and third projections are prevented from interfering with pistons in the combustion chamber.

Further, preferably, the top ends of the second and third projections are located on the tip-end side with reference to the top end of the center electrode, and more preferably, located on the tip-end side with reference to the spark discharge gap.

Preferably, the first projection has a top whose protrusion height from the top end portion is equal to or lower than a top of the ground electrode and is equal to or higher than a top of the insulation porcelain in the axial direction.

In this case, while the blocking function of the first projection is ensured, the size of the spark plug can be reduced in the axial direction. As a result, while the ignitability of the spark plug is ensured, the first projection is prevented from interfering with pistons in the combustion chamber.

Preferably, the top end of the first projection is located on the tip-end side with reference to the top end of the center electrode, and more preferably located on the tip-end side with reference to the spark discharge gap.

Still preferably, the second and third electrodes have widths in the circumferential direction, wherein the widths are smaller than a width of the ground electrode in the circumferential direction at positions of the second and third electrodes, the positions being the closest to the spark discharge gap in the axial direction.

In this case, the airflow is easily prevented from being blocked by the second or third projection, thereby effectively preventing the airflow from being stagnated in the vicinity of the spark discharge gap.

The term "plug circumferential width" refers to a width in the direction of the tangent line of the circle centering on the center axis of the spark plug, as viewed from the axial direction of the spark plug.

By way of example, the first, second and third protrusions are protruded parallely with each other from the top end portion in the axial direction.

In this case, stagnation of the airflow is prevented from being caused in the vicinity of the spark discharge gap by the first projection, the second and third projections. Further, since the shapes of the first projection, the second projection and the third projection can be simplified, the spark plug with a simplified configuration can be realized.

The term "parallel to the plug axial direction" encompasses a state of being substantially parallel to the axial direction of the spark plug to an extent of exerting the above effects in spite of the presence of a slight slant with respect to the axial direction of the spark plug.

Preferably, the second and third protrusions have cross sections at positions thereof which are the closest to the spark discharge gap in the axial direction, wherein each of the cross sections has a width in the radial direction which is larger than a width in the circumferential directions.

In this case, the airflow that flows toward the vicinity of the top end portion of the spark plug from the upstream can be effectively and easily directed to the spark discharge gap by the second or third projection. In addition, the second or third projection is unlikely to block the airflow that flows toward the vicinity of the top end portion of the spark plug from the upstream. Specifically, the second or third projection exerts a function of guiding the airflow to the spark discharge gap (guiding function) when the ground electrode or the first projection is located upstream of the airflow with reference to the spark discharge gap. However, the second or third projection, when it is located upstream of the airflow with reference to the spark discharge gap, may block the airflow that is directed to the spark discharge gap, depending on the shape of the second or third projection. The guiding function is more easily exerted as the width of the second or third projection is increased in the plug radial direction. Also, the effect of blocking the airflow directed to the spark discharge gap is more easily exerted as the width of the second or third projection is increased in the plug circumferential direction. Accordingly, when the second or third projection has a shape in which the width in the plug radial direction is larger than the width in the plug circumferential direction, the airflow that is directed to the spark discharge gap is prevented from being blocked, and at the same time, the airflow is efficiently and easily directed to the spark discharge gap.

Preferably, the second and third protrusions have cross sections at positions thereof which are the closest to the spark discharge gap in the axial direction, wherein each of the cross sections is triangular.

In this case, a baffle surface with a large area is formed in each of the second and third projections. At the same time, the second and third projections are easily prevented from protruding radially inward and outward of the spark plug from the top end portion of the housing. Accordingly, the problem of the transverse flying spark or the problem associated with the mounting properties is solved. At the same time, the guiding function of the second and third projections is enhanced.

Preferably, the first projection and the ground electrode have the same plug circumferential width at a position axially nearest to the spark discharge gap. In this case, the airflow is prevented from being varied in the spark discharge gap, in a state where the first projection is located upstream of the airflow and in a state where the ground electrode is located upstream of the airflow. As a result, the ignitability is effectively prevented from being varied by the mounting posture of the spark plug with respect to the internal combustion engine.

Preferably, the first projection and the ground electrode have a cross section of the same shape at a position axially nearest to the spark discharge gap. In this case, the airflow is more effectively prevented from being varied in the spark discharge gap, in a state where the first projection is located upstream of the airflow and in a state where the ground electrode is located upstream of the airflow. As a result, the ignitability is more effectively prevented from being varied depending on the mounting posture of the spark plug with respect to the internal combustion engine.

DETAILED DESCRIPTION OF THE PREFERRED EMBODIMENTS

With reference to the accompanying drawings, hereinafter are described several embodiments of a spark plug of the present invention. Throughout the specification, whenever the terms "axial direction", "axial" or "axially", and "circumferential direction", "circumferential" or "circumferentially", and "radial direction", "radial" or "radially" are used, these terms are used with reference to the circumference, axis and radius, respectively, of the spark plug of the present embodiment (refer to FIG. 1). The axial direction is in accordance with the length-wise direction of the spark plug. Further, the direction in which the spark plug is inserted into the combustion chamber is referred to as "tip-end side", and the opposite direction is referred to as "base-end side" (also refer to FIG. 1).

(First Embodiment)

Referring to FIGS. 1 to 7, hereinafter is described a first embodiment of a spark plug 1 for an internal combustion engine of the present invention.

Figure 1:
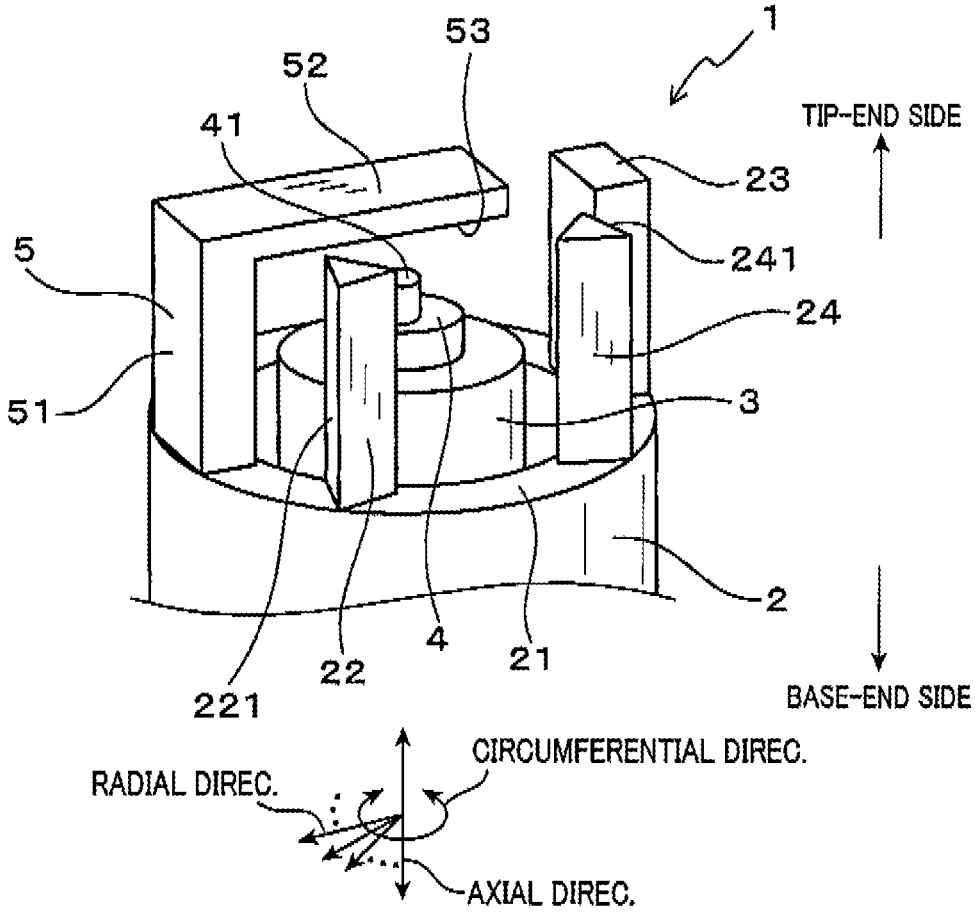
FIG. 1 is a perspective view illustrating a top end portion of a spark plug, according to a first embodiment of the present invention.
Figure 2:
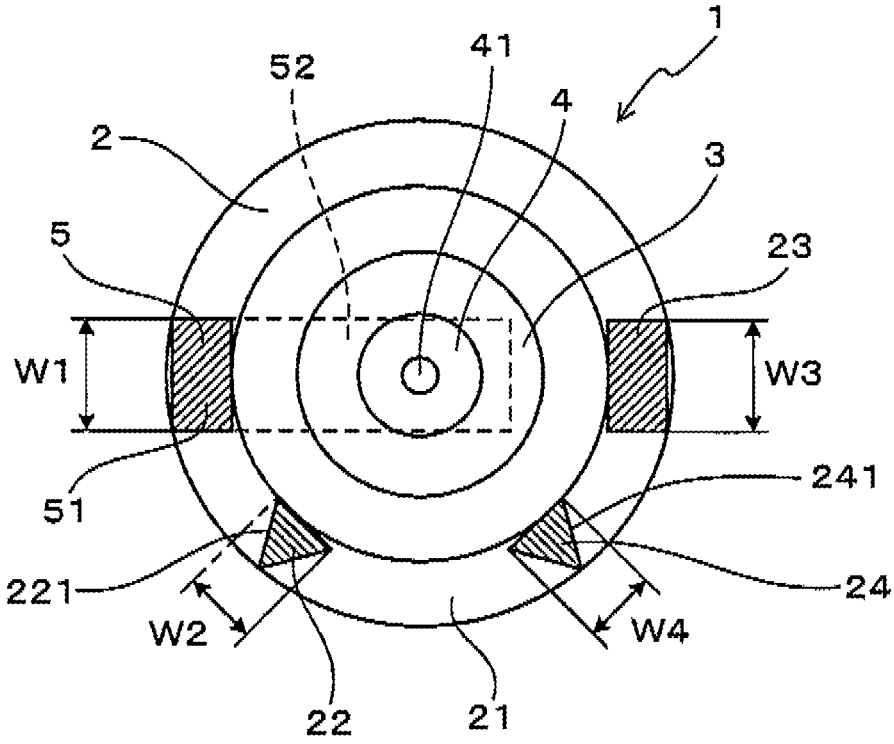
FIG. 2 is a cross-sectional view illustrating the spark plug, taken at a position in a spark discharge gap along a plane perpendicular to the axial direction.
Figure 3:
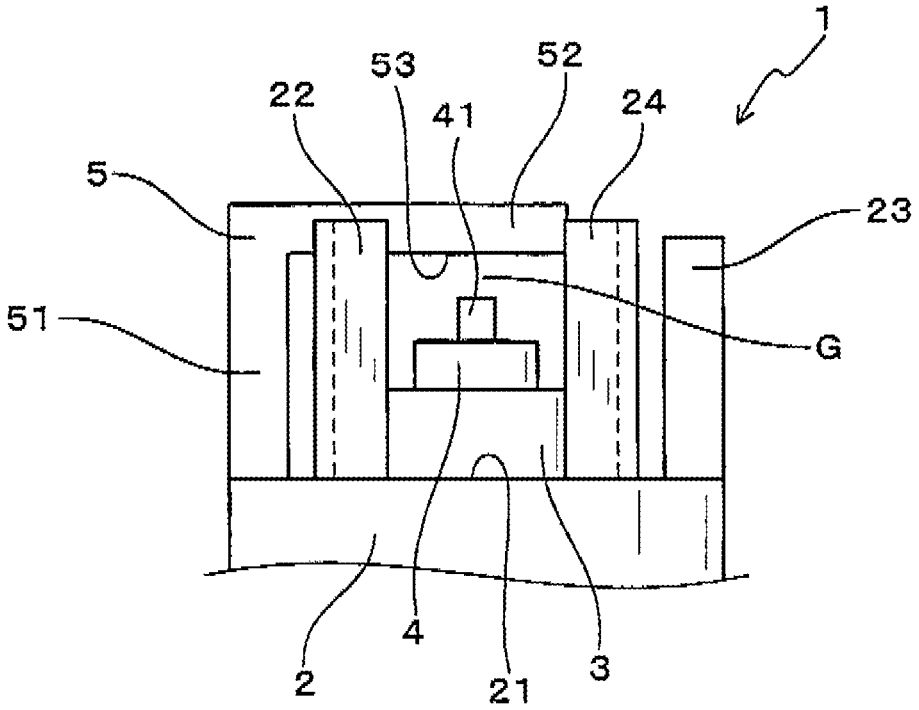
FIG. 3 is a side view illustrating the top end portion of the spark plug.

As shown in FIGS. 1 to 3, the spark plug 1 of the first embodiment includes a cylindrical housing 2, an insulation porcelain 3 held inside the housing 2, and a center electrode 4 held inside the insulation porcelain 3 such that a top end portion of the center electrode 4 is projected out of the insulation porcelain 3. Further, the spark plug 1 includes a ground electrode 5 that is projected out of a top end portion 21 of the housing 2 toward a tip-end side. A spark discharge gap G is formed between the center electrode 4 and the ground electrode 5.

As shown in FIGS. 1 and 3, the ground electrode 5 includes a vertical portion 51 and an opposing portion 52. The vertical portion 51 stands upright from the top end portion 21 of the housing 2. The opposing portion 52 is provided by bending an end of the vertical portion 51 to have an opposing surface 53 that axially faces a top end portion 41 of the center electrode 4.

The spark plug 1 also includes an opposite projection 23 (serving as a first projection), an electrode-side baffle projection 22 (serving as a second projection) and an opposite-side baffle projection 24 (serving as a third projection), which are projected from the top end portion 21 of the housing 2 toward the tip-end side. The opposite projection 23 is projected from the top end portion 21 of the housing 2 toward the tip-end side, at a position (a first position) opposite to the ground electrode 5, being interposed by the center electrode 4. The electrode-side baffle projection 22 is projected from the top end portion 21 of the housing 2 toward the tip-end side, at a position (a second position) near the ground electrode 5 with reference to the opposite projection 23. The opposite-side baffle projection 24 is projected from the top end portion 21 of the housing 2 toward the tip-end side, at a position (serving as a third position) near the opposite projection 23 with reference to the ground electrode 5.

As shown in FIGS. 1 and 2, the electrode-side and opposite-side baffle projections 22 and 24 are formed, being concentrated on one circumferential area between the ground electrode 5 and the opposite projection 23. As viewed from the tip-end side, the top end portion 21 of the housing 2 is formed into an annular shape. The top end portion 21 includes two circumferential areas that are defined by the ground electrode 5 and the opposite projection 23, which are provided at mutually opposite positions in the radial direction. One of the two areas includes the electrode-side and opposite-side baffle projections 22 and 24 and the other of the two areas does not include these projections.

The opposite projection 23, the electrode-side baffle projection 22 and the opposite-side baffle projection 24 are projected in the axial direction so as to be parallel to each other. The ground electrode 5 is arranged such that the vertical portion 51 is parallel to the axial direction and the opposing portion 52 is parallel to the radial direction.

The electrode-side and opposite-side baffle projections 22 and 24 have respective top ends which are flush with the top end of the ground electrode 5, or which are positioned on the base-end side with reference to the top end of the ground electrode 5. In addition, the top ends of the projections 22 and 24 are flush with the top end of the insulation porcelain 3, or are positioned on the tip-end side with reference to the top end of the insulation porcelain 3. The opposite projection 23 has a top end which is flush with the top end of the ground electrode 5, or which is positioned on the base-end side with reference to the top end of the ground electrode 5. In addition, the top end of the opposite projection 23 is flush with the top end of the insulation porcelain 3, or is positioned on the tip-end side with reference to the top end of the insulation porcelain 3. In the present embodiment, the top ends of the opposite projection 23, the electrode-side baffle projection 22 and the opposite-side baffle projection 24 are positioned on the tip-end side in the axial direction with reference to the opposing surface 53 of the ground electrode 5.

The electrode-side and opposite-side baffle projections 22 and 24 each have a circumferential width smaller than that of the ground electrode 5, at a position axially nearest to the spark discharge gap G. In the present embodiment, the "position axially nearest to the spark discharge gap G" in the electrode-side or opposite-side baffle projection 22 or 24 refers to a position included in a plane which is perpendicular to the axial direction and resides in the spark discharge gap G (this position is hereinafter refers to as "axial position in the spark discharge gap G"). Thus, at the same axial position in the spark discharge gap G, the electrode-side and opposite-side baffle projections 22 and 24 have circumferential widths W2 and W4, respectively, which are smaller than a circumferential width W1 of the vertical portion 51 of the ground electrode 5.

As shown in FIG. 2, the opposite projection 23 and the ground electrode 5 each have the same circumferential width at a position axially nearest to the spark discharge gap G. In the present embodiment, the "position axially nearest to the spark discharge gap G" in each of the opposite projection 23 and the ground electrode 5, as well, refers to the axial position of the spark discharge gap G. Thus, at the same axial position in the spark discharge gap G, the opposite projection 23 and the ground electrode 5 have the same circumferential widths W3 and W1, respectively. Further, the opposite projection 23 and the ground electrode 5 have the same cross-sectional shape in a plane which is perpendicular to the axial direction and resides in the spark discharge gap G. In the present embodiment, the cross-sectional shape is rectangular.

The electrode-side baffle projection 22 has an electrode-side baffle surface 221 oriented to the ground electrode 5 while the opposite-side baffle projection 24 has an opposite-side baffle surface 241 oriented towards the opposite projection 23. Here, an expression "oriented to the ground electrode 5" refers to "oriented to the vertical portion 51 of the ground electrode 5 in relation to the circumferential direction along the top end portion 21 of the housing 2. Also, an expression "oriented to the opposite projection 23" refers to "oriented to the opposite projection 23 in relation to the circumferential direction along the top end portion 21 of the housing 2. As viewed from the axial direction, lines extended from the electrode-side and opposite-side baffle surfaces 221 and 224 do not necessarily have to pass through the spark discharge gap G (the top end portion 41 of the center electrode 4). For example, these lines may just have to pass between the vertical portion 51 and the opposite projection 23.

The electrode-side and opposite-side baffle projections 22 and 24 each have a triangular cross-sectional shape in a plane perpendicular to the axial direction. In other words, the electrode-side and opposite-side baffle projections 22 and 24 are each formed into a triangular prism. In the present embodiment, in particular, the triangular cross section is in an equilateral triangular shape. The electrode-side baffle surface 221 is formed in a surface of the electrode-side baffle projection 22, the surface including one side of the equilateral triangle. Similarly, the opposite-side baffle surface 241 is formed in a surface of the opposite-side baffle projection 24, the surface including one side of the equilateral triangle.

Each of the electrode-side baffle projection 22, the opposite-side baffle projection 24 and the opposite projection 23 has a uniform cross-sectional shape throughout its axial length. In other words, these projections are each formed into a triangular prism or a quadratic prism.

The following is an example of dimension and material of each part of the spark plug 1 of the present embodiment.

The housing 2 has a diameter of 10.2 mm and a thickness at the top end portion 21 of the housing 2 is 1.4 mm. The circumferential widths W2 and W4 of the electrode-side and opposite-side baffle projections 22 and 24, respectively, are both 1.4 mm. The circumferential widths W1 and W3 of the ground electrode 5 and the opposite projection 23, respectively, are both 2.6 mm.

The top end portion 41 of the center electrode 4 is projected in the axial direction by 1.5 mm from the end of the insulation porcelain 3. The spark discharge gap G has an axial length of 1.1 mm.

The top end portion 41 of the center electrode 4 is configured by a noble-metal chip which is made of iridium. The housing 2 and the ground electrode 5 are made of a nickel alloy.

The dimensions and materials mentioned above are common to those of the samples used in Experimental Example 1 which will be described later.

However, the dimensions and the materials of the parts of the spark plug 1 shall not be particularly limited.

The spark plug 1 of the present embodiment is used for an internal combustion engine such as of a vehicle.

The advantageous effects of the present embodiment will be described below.

The spark plug 1 has the opposite projection 23, the electrode-side baffle projection 22 and the opposite-side baffle projection 24. Being provided with these projections, an airflow (flow of air-fuel mixture) that occurs in the combustion chamber and is directed to the spark discharge gap G will be prevented from being blocked, in whatever posture the spark plug 1 may be mounted with respect to the internal combustion engine.

Figure 4:
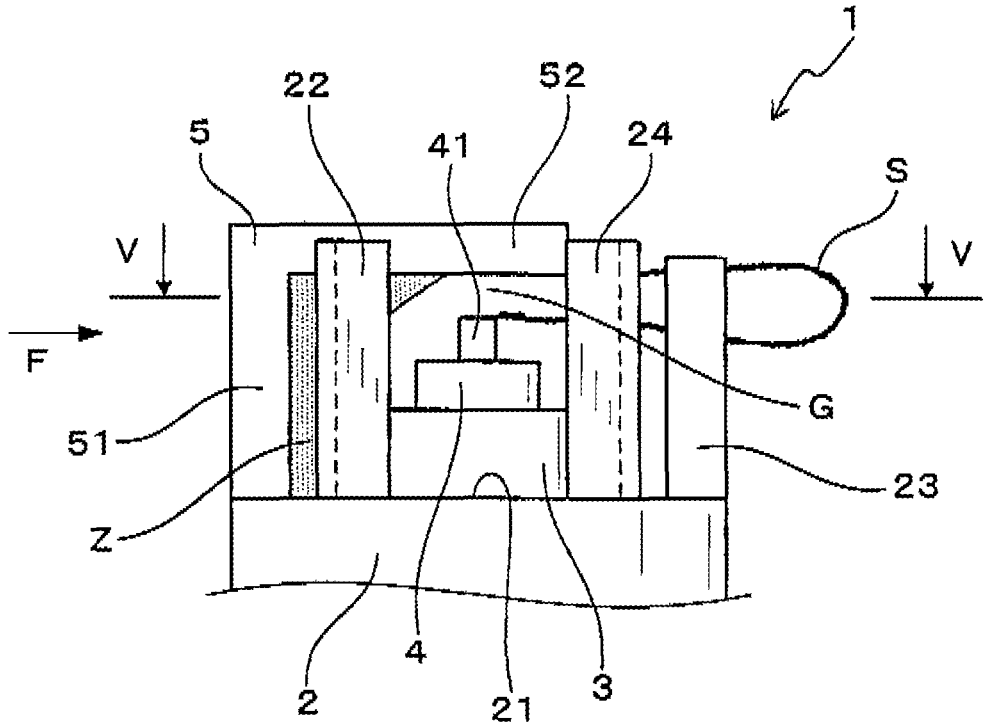
FIG. 4 is a side view illustrating the top end portion of the spark plug in a state where a vertical portion of a ground electrode is located upstream of airflow.
Figure 5:
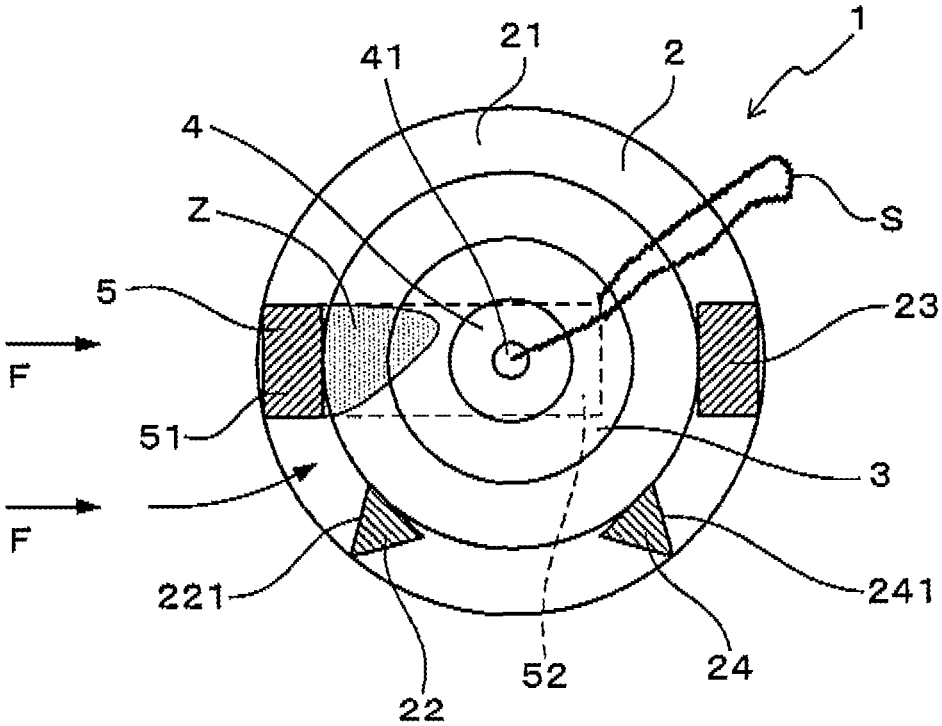
FIG. 5 is a cross-sectional view taken along the line V-V of FIG. 4.

FIG. 4 shows a state where a part of the ground electrode 5 (vertical portion 51) is located upstream of the spark discharge gap G. FIG. 5 is a cross-sectional view taken along the line V-V of FIG. 4. As shown In FIGS. 4 and 5, when a part of the ground electrode 5 is located upstream of the spark discharge gap G, an airflow (flow of air-fuel mixture) F that has passed by the side of the ground electrode 5 from the upstream is directed to the spark discharge gap G by the electrode-side baffle projection 22. More specifically, the electrode-side baffle projection 22 serves as a guide for the airflow F and directs the airflow F to the spark discharge gap G. Accordingly, stagnation of the airflow F is prevented in the vicinity of the spark discharge gap G. As a result, a discharge spark S is extended to a large extent and stable ignitability is ensured in the spark plug 1, In FIGS. 4 and 5, the area indicated by a reference Z shows stagnation of the airflow F. The same applies to other figures.

Figure 6:
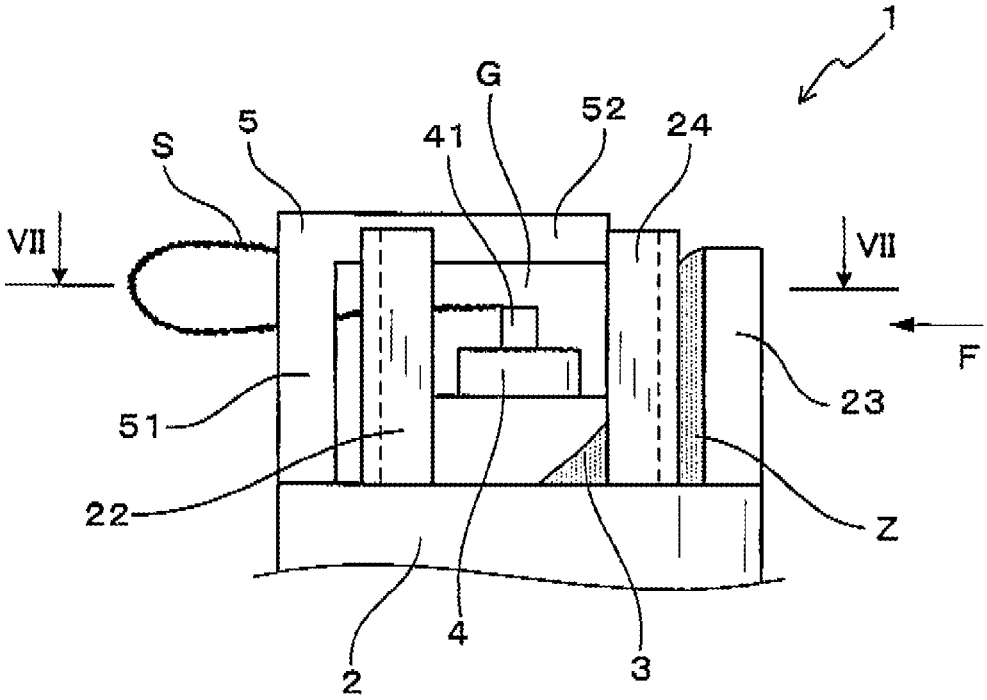
FIG. 6 is a side view illustrating the top end portion of the spark plug in a state where the vertical portion of the ground electrode is located downstream of airflow.
Figure 7:
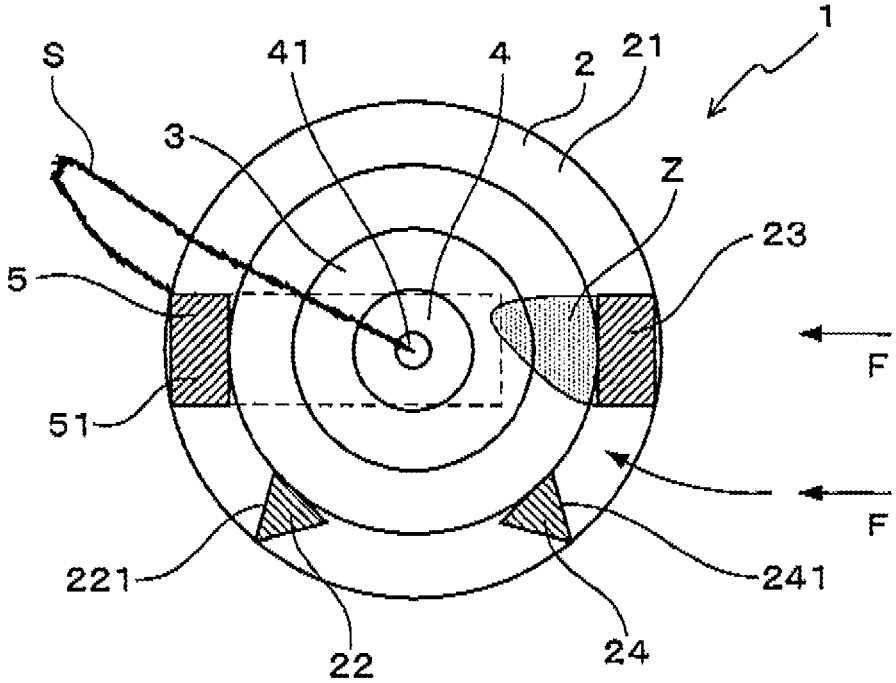
FIG. 7 is a cross-sectional view taken along the line VII-VII of FIG. 6.

FIG. 6 shows a state where a portion of the ground electrode 5 (vertical portion 51) is located downstream of the spark discharge gap G. FIG. 7 is a cross-sectional view taken along the line VII-VII of FIG. 6. As shown in FIGS. 6 and 7, when a portion of the ground electrode 5 is located downstream of the spark discharge gap G, the opposite projection 23 is located upstream of the spark discharge gap G. In this case, the airflow F that has passed by the opposite projection 23 from the upstream is directed to the spark discharge gap G by the opposite-side baffle projection 24.

In the absence of the opposite projection 23, when a part of the ground electrode 5 (vertical portion 51) is located downstream of the spark discharge gap G, the airflow F that has passed through the spark discharge gap G tends to collide against the ground electrode 5. In this case, the force of the airflow F passing through the spark discharge gap G tends to be weakened. As a result, the discharge spark S is unlikely to be extended to a large extent (see FIG. 9C). Therefore, when a part of the ground electrode 5 (vertical portion 51) is located downstream of the spark discharge gap G, the ignitability tends to be comparatively impaired. In this regard, provision of the opposite projection 23 can prevent the airflow F that would directly flow toward the spark discharge gap G from the totally opposite side of the ground electrode 5 to thereby solve the foregoing problem. As mentioned above, since the airflow F that has passed by the side of the opposite projection 23 is directed to the spark discharge gap G by the opposite-side baffle projection 24, the force of the airflow F passing through the spark discharge gap G can be ensured. In this way, the discharge spark S can be extended to a large extent and the ignitability is ensured.

The opposite projection 23, the electrode-side baffle projection 22 and the apposite-side baffle projection 24 are simply configured by projecting them from the top end portion 21 of the housing 21 to the tip-end side. In other words, neither ingenuity is required in shaping the ground electrode 5, nor the ground electrode 5 is required to be in a complicated shape.

The electrode-side and opposite-side baffle projections 22 and 24 are formed being concentrated in one circumferential area between the ground electrode 5 and the opposite projection 23. Thus, the airflow that has been directed to the spark discharge gap G by the electrode-side baffle projection 22 (opposite-side baffle projection 24) is reliably permitted to pass through the spark discharge gap G without being blocked by the opposite-side baffle projection 24 (electrode-side baffle projection 22). In this way, the ignitability is easily enhanced.

The electrode-side and opposite-side baffle projections 22 and 24 have respective top ends which are flush with the top end of the ground electrode 5, or which are positioned on the base-end side with reference to the top end of the ground electrode 5. In addition, the top end surfaces of the projections 22 and 24 are flush with the top end of the insulation porcelain 3, or are positioned on the tip-end side with reference to the top end of the insulation porcelain 3. Thus, the guiding function of the electrode-side and opposite-side baffle projections 22 and 24 is ensured, while the size of the spark plug 1 in the axial direction is reduced. As a result, while ensuring the ignitability of the spark plug 1, the electrode-side and opposite-side baffle projections 22 and 24 are prevented from interfering with pistons in the combustion chamber.

The opposite projection 23 has a top end which is flush with the top end of the ground electrode 5, or which is positioned on the base-end side with reference to the top end of the ground electrode 5. In addition, the top end of the opposite projection 23 is flush with the top end of the insulation porcelain 3, or is positioned on the tip-end side with reference to the top end of the insulation porcelain 3. Therefore, the blocking function of the opposite projection 23 is ensured, while the size of the spark plug 1 in the axial direction is reduced. As a result, while ensuring the ignitability of the spark plug 1, the opposite projection 23 is prevented from interfering with pistons in the combustion chamber.

The circumferential widths W2 and W4 of the electrode-side and opposite-side baffle projections 22 and 24, respectively, are smaller than the circumferential width W1 of the ground electrode 5. Thus, the airflow is easily prevented from being blocked by the electrode-side and opposite-side baffle projections 22 and 24. Accordingly, stagnation of the airflow is effectively prevented in the vicinity of the spark discharge gap G.

The opposite projection 23, the electrode-side baffle projection 22 and the opposite-side baffle projection 24 are projected in the axial direction, being parallel to each other. Thus, stagnation of the airflow, which would be attributed to the opposite projection 23, the electrode-side baffle projection 22 and the opposite-side baffle projection 24, is prevented from being caused in the vicinity of the spark discharge gap G. Further, since shapes of the opposite projection 23, the electrode-side baffle projection 22 and the opposite-side baffle projection 24 can be simplified, the spark plug 1 is realized with a simple configuration.

As described above, according to the present embodiment, a spark plug for an internal combustion engine with a simple configuration is provided, and the spark plug is able to ensure stable ignitability, irrespective of its mounting posture with respect to the internal combustion engine.

COMPARATIVE EXAMPLE 1

Referring to FIGS. 8 to 11, hereinafter is described Comparative Example 1. Comparative Example 1 provides an example of a normal spark plug 9 that includes a ground electrode 95 which is configured by a vertical portion 951 and an opposing portion 952.

Figure 8:
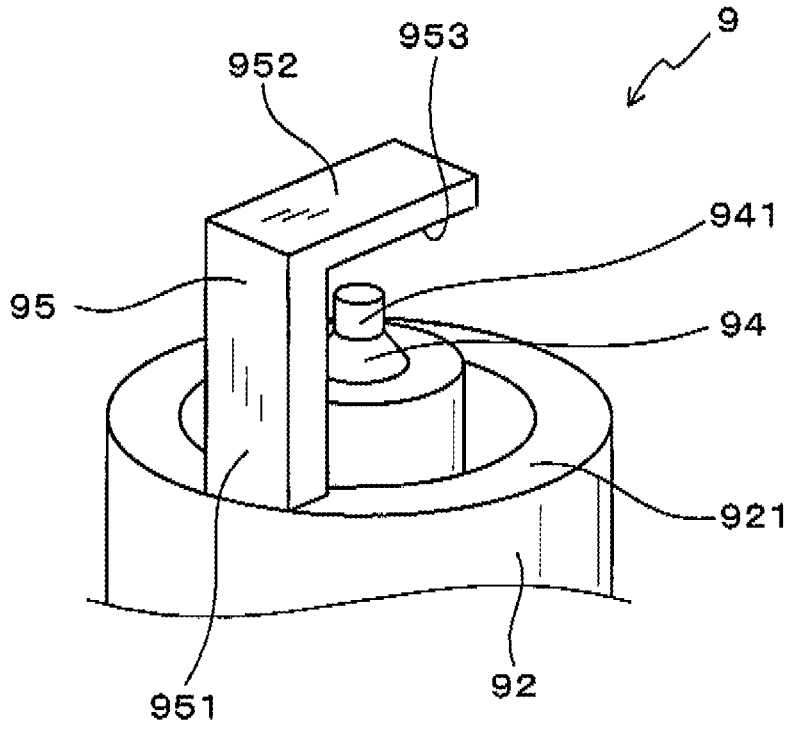
FIG. 8 is a perspective view illustrating a top end portion of a spark plug, according to Comparative Example 1.

As shown in FIG. 8, the ground electrode 95 includes the vertical portion 951 and the opposing portion 952. The vertical portion 951 stands upright, toward the tip-end side, from an end surface 921 of a housing 92. The opposing portion 952 is provided by bending an end of the vertical portion 951 to have an opposing surface 953 that axially faces a top end portion 941 of a center electrode 94.

In other words, the spark plug 9 does not have a configuration, as in the first embodiment, in which the opposite projection 23, the electrode-side baffle projection 22 and the opposite-side baffle projection 24 are arranged being projected toward the tip-end side from the top end portion of the housing (see FIG. 1). The rest of the configuration is similar to the first embodiment.

Figure 9A:
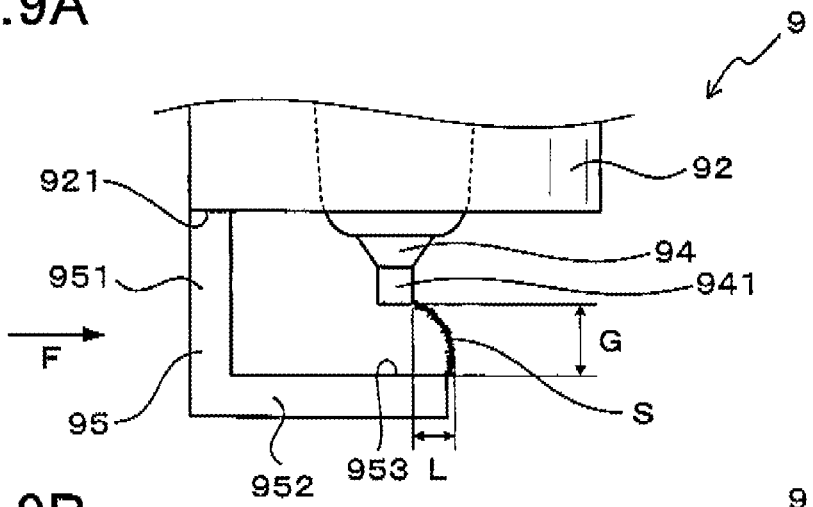
FIG. 9A is an explanatory view illustrating discharge in a state where a vertical portion of a ground electrode is located upstream of airflow, according to Comparative Example 1.
Figure 9B:
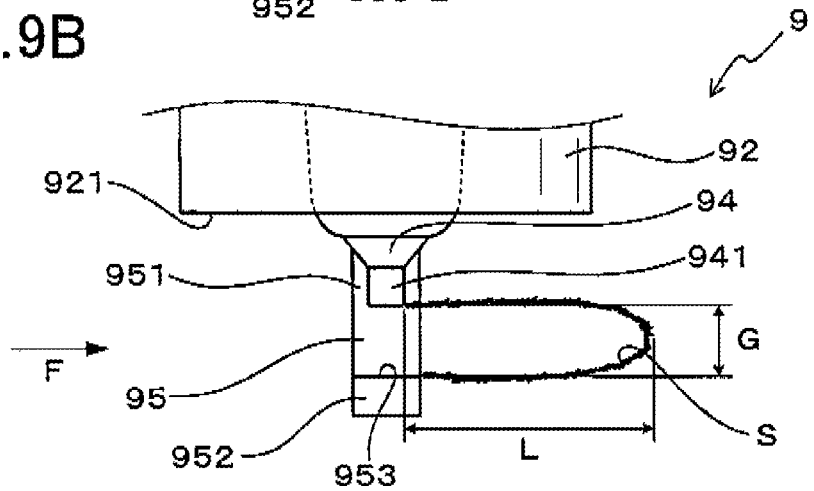
FIG. 9B is an explanatory view illustrating discharge in a state where the vertical portion is located at a position where it is perpendicular to airflow, according to Comparative Example 1.
Figure 9C:
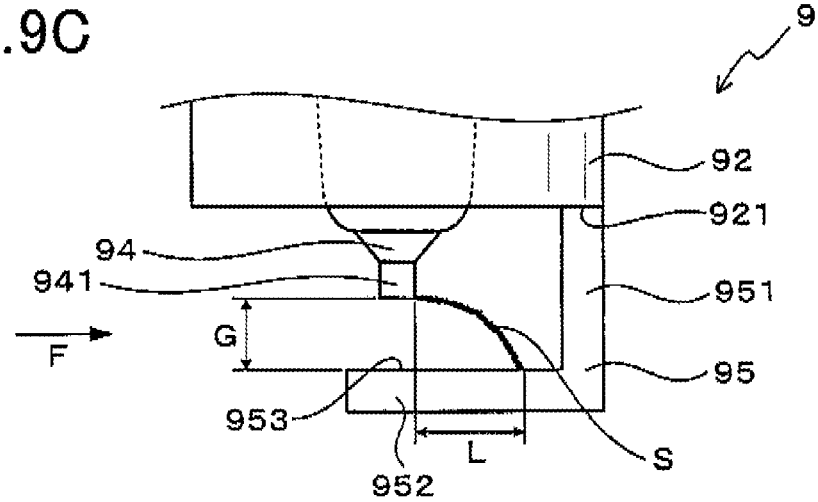
FIG. 9C is an explanatory view illustrating discharge in a state where the vertical portion is located upstream of airflow, according to Comparative Example 1.

In Comparative Example 1, the spark plug 9 is also used being mounted on an internal combustion engine. In FIGS. 9A to 9C, reference L indicates the length of the discharge spark S in the spark discharge gap G. As shown in FIGS. 9A to 9C, the discharge length L of the discharge spark S considerably varies, depending on the direction of mounting the spark plug 9. This is associated with the direction of the airflow F in the combustion chamber.

Specifically, as shown in FIG. 9A, the discharge length L is extremely small when the spark plug 9 is mounted on the internal combustion engine so that the vertical portion 951 of the ground electrode 95 is located upstream of the spark discharge gap G.

On the other hand, as shown in FIG. 9B, the discharge length L is extremely large when the spark plug 9 is mounted on the internal combustion engine so that the portion 951 of the ground electrode 95 is located at a position where the vertical direction of the vertical portion 951 is perpendicular to the direction of the airflow F.

Further, as shown in FIG. 9C, when the spark plug 9 is mounted on the internal combustion engine so that the vertical portion 951 of the ground electrode 95 is located downstream of the spark discharge gap G, the discharge length L is large to some extent, but smaller than the one shown in FIG. 9B.

The discharge length L here refers to the length of discharge in a direction perpendicular to the axial direction of the spark plug.

The variations of the discharge length L mentioned above were obtained by measuring the discharge length L of the discharge spark S that was generated in the spark discharge gap G under the condition where the flow rate of the airflow F was set to 15 m/s. Specifically, as shown in FIG. 10, the discharge length L considerably differed, depending on the mounting posture of the spark plug 9.

Figure 10:
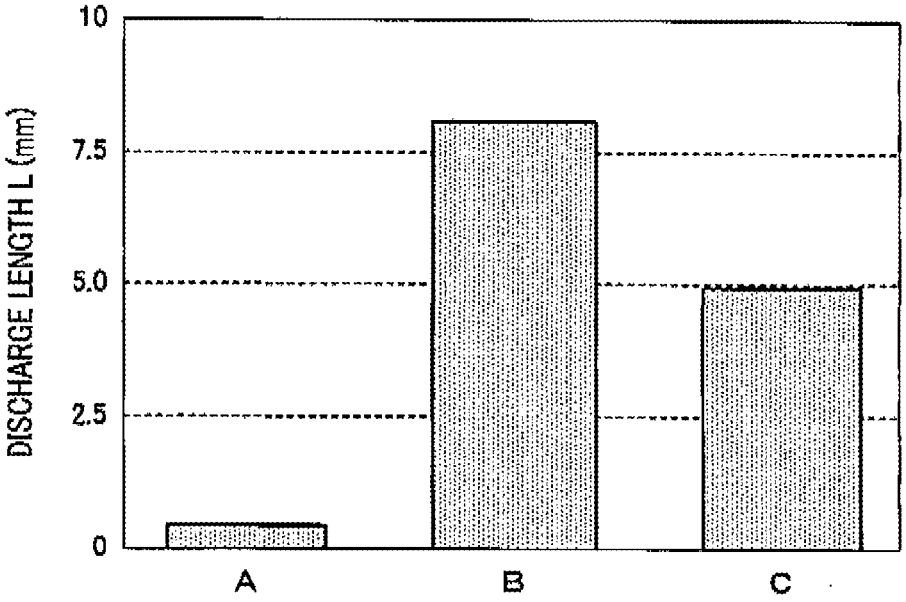
FIG. 10 is a comparison graph showing discharge length, according to Comparative Example 1.

In FIG. 10, A, B and C show the discharge length L in the postures shown in FIGS. 9A, 9B and 9C, respectively.

Figure 11:
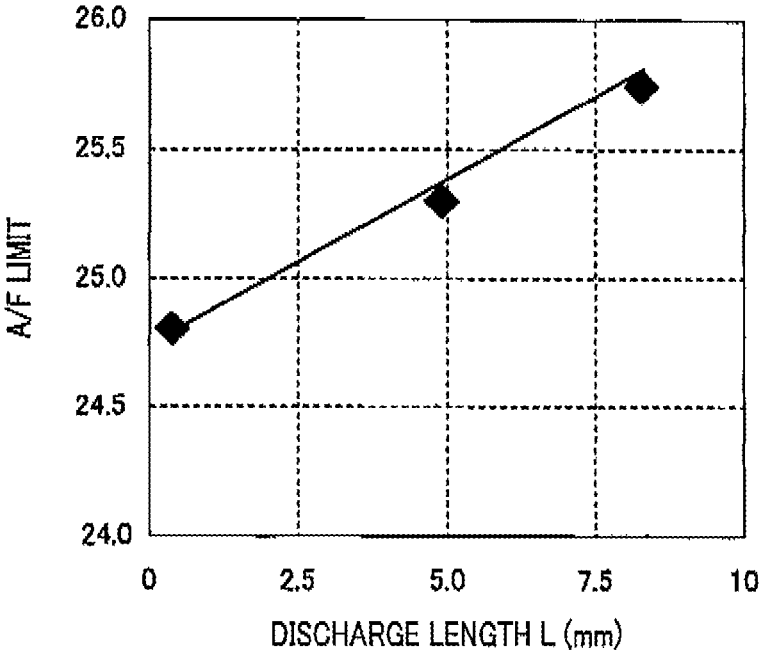
FIG. 11 is a diagram showing discharge length, relative to A/F limit, according to Comparative Example 1.

The relationship between the discharge length L and the ignition performance of the spark plug 9 will be understood from FIG. 11. As shown in FIG. 11, it was confirmed that a larger discharge length L more enhances the ignition performance. The ignition performance here is evaluated on the basis of a critical value of air-fuel ratio that enables ignition of the air-fuel mixture, i.e. an A/F limit. A higher A/F limit (thinner air-fuel mixture having ignition potential) achieves higher ignition performance.

As will be understood from FIGS. 10 and 11, the spark plug 9 of Comparative Example 1 causes considerable variations in the ignitability, depending on its mounting posture with respect to the internal combustion engine.

COMPARATIVE EXAMPLE 2

Figure 12:
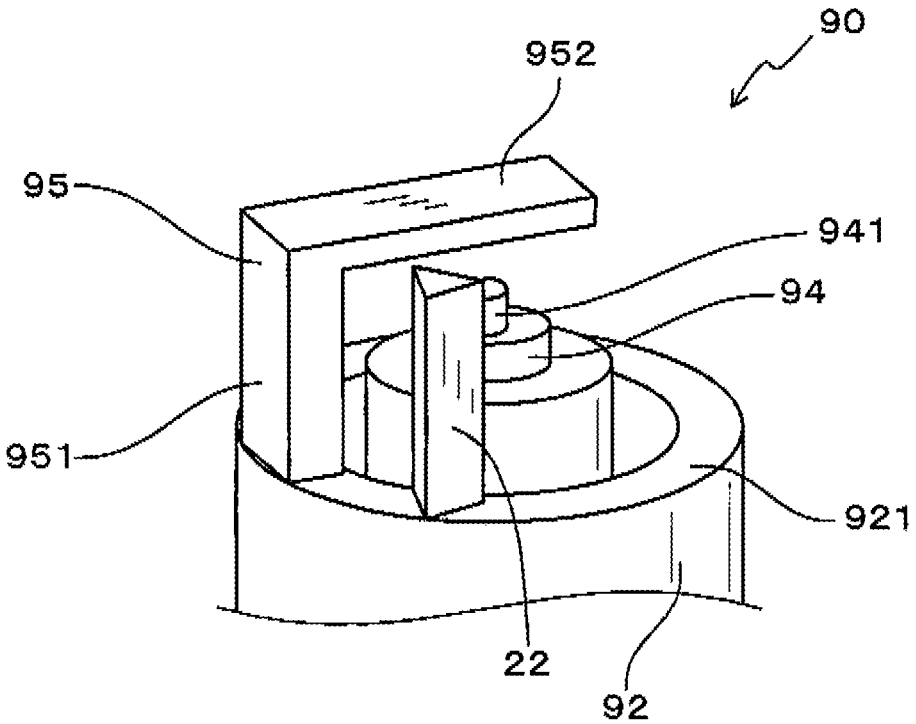
FIG. 12 is a perspective view illustrating a top end portion of a spark plug, according to Comparative Example 2.

FIG. 12 shows, as an example, a spark plug 90 for an internal combustion engine. The spark plug 90 includes a ground electrode 95 and an electrode-side baffle projection 22. Specifically, the spark plug 90 of Comparative Example 2 is configured without being provided with the opposite projection 23 and the opposite-side baffle projection 24 of the spark plug 1 according to the first embodiment (see FIG. 1). The electrode-side baffle projection 22 is similar to the one used in the spark plug 1 according to the first embodiment.

The rest of the configuration is similar to Comparative Example 1. The components designated with the same reference numerals as those of Comparative Example 1 are the components identical or similar to those of Comparative Example 1 unless otherwise specified.

EXPERIMENTAL EXAMPLE 1

Figure 13:
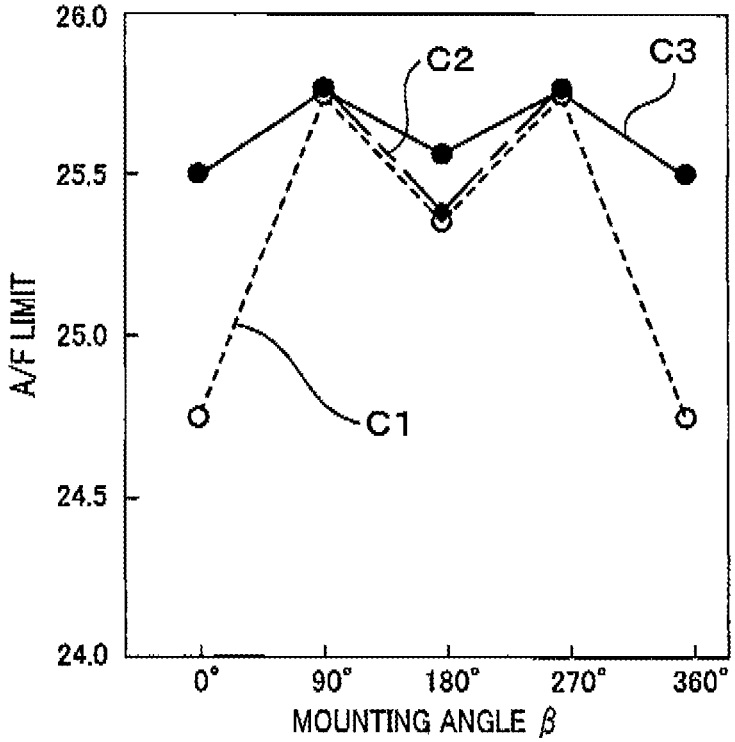
FIG. 13 is a diagram showing mounting angle of a spark plug with respect to airflow direction, relative to A/F limit, according to Experimental Example 1.

As shown in FIG. 13, in Experimental Example 1, the spark plugs 1, 9 and 90 of the first embodiment, Comparative Example 1 and Comparative Example 2, respectively, were used to investigate how the A/F limit varied depending on the location of the vertical portions 51 and 951 of the ground electrodes 5 and 95, respectively, with respect to the airflow F.

Specifically, the A/F limit was measured by changing a mounting angle β in increments of 90° in a range of 0° to 360°. The mounting angle β is an angle between the direction of entry of the airflow F into the spark plug 1 and the radial direction connecting between the circumferential position of the vertical portion 51 of the ground electrode 5 and the center axis of the spark plug 1, when the spark plug 1 of the first embodiment is viewed in the axial direction from the tip-end side. More specifically, when the mounting angle β is 0°, the vertical portion 51 of the ground electrode 5 is located upstream of the spark discharge gap G and when the mounting angle β is 180°, the vertical portion 51 of the ground electrode 5 is located downstream of the spark discharge gap G. The similar measurements were performed for the spark plug 9 of Comparative Example 1 and the spark plug 90 of Comparative Example 2.

The A/F limit was measured for the spark plugs 1, 9 and 90 of the first embodiment and Comparative Examples 1 and 2, respectively, by changing the orientation of the spark plug, as mentioned above, with respect to the airflow F under the condition where the flow rate of the airflow F was set to 14 m/s.

The results are shown in FIG. 13. In FIG. 13, the polygonal line indicated by a broken line and designated with reference C1 shows measurements of the spark plug 9 of Comparative Example 1. Similarly, the polygonal line indicated by another broken line and designated with reference C2 shows measurements of the spark plug 90 of Comparative Example 2, and the polygonal line indicated by a solid line and designated with reference C3 shows measurements of the spark plug 1 of the first embodiment. The polygonal line C2 coincides with the polygonal line C3 in the ranges of 0° to 90° and 270° to 360°.

In the graph shown in FIG. 13, the horizontal axis indicates the mounting angle β and the vertical axis indicates the A/F limit. Better ignitability is exhibited by higher A/F limit.

As shown in FIG. 13, the polygonal line C1 indicating the A/F limit of the spark plug 9 of Comparative Example 1 shows drastic variation of the A/F limit depending on the mounting angle β. This means that the A/f limit, i.e. the ignitability, of the spark plug 9 of Comparative Example 1 drastically varies, depending on the direction of entry of the airflow F into the spark plug 9, i.e. the mounting posture of the spark plug 9 with respect to the the internal combustion engine. In particular, as can be seen, the A/F limit is considerably low at the position where the mounting angle β is 0° (360°). In other words, it will be understood that, when the vertical portion 951 of the ground electrode 95 is located upstream of the airflow F with reference to the spark discharge gap G, the A/F limit tends to be extremely decreased and the ignition performance tends to be considerably impaired.

Figure 14A:
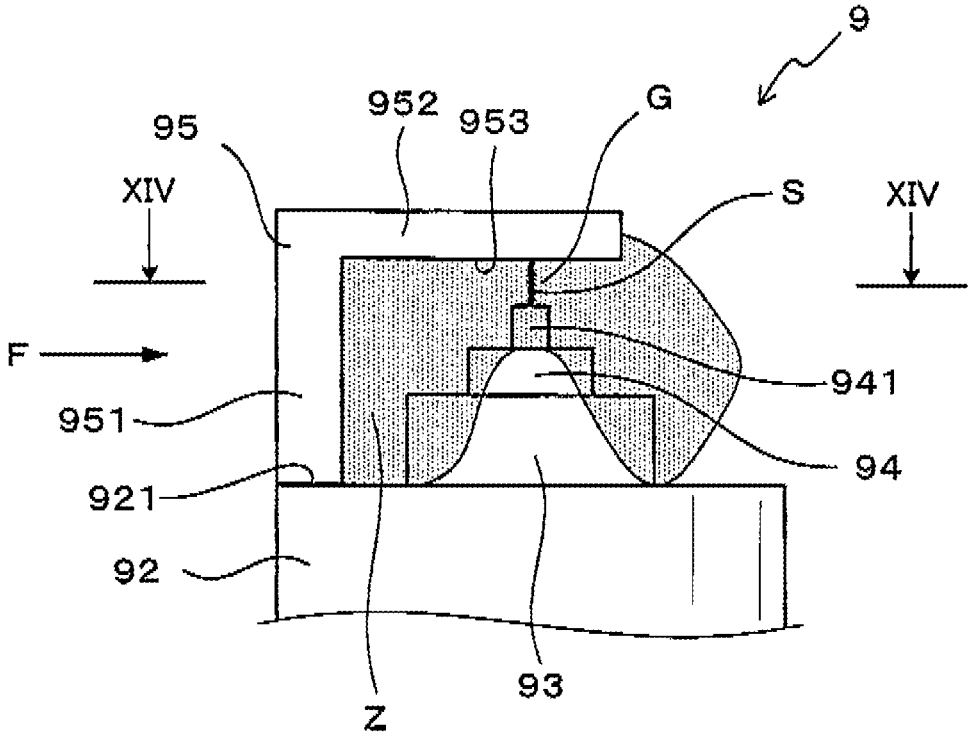
FIG. 14A is an explanatory side view illustrating a state where the vertical portion of the ground electrode according to Comparative Example 1 is located upstream of airflow.
Figure 14B:
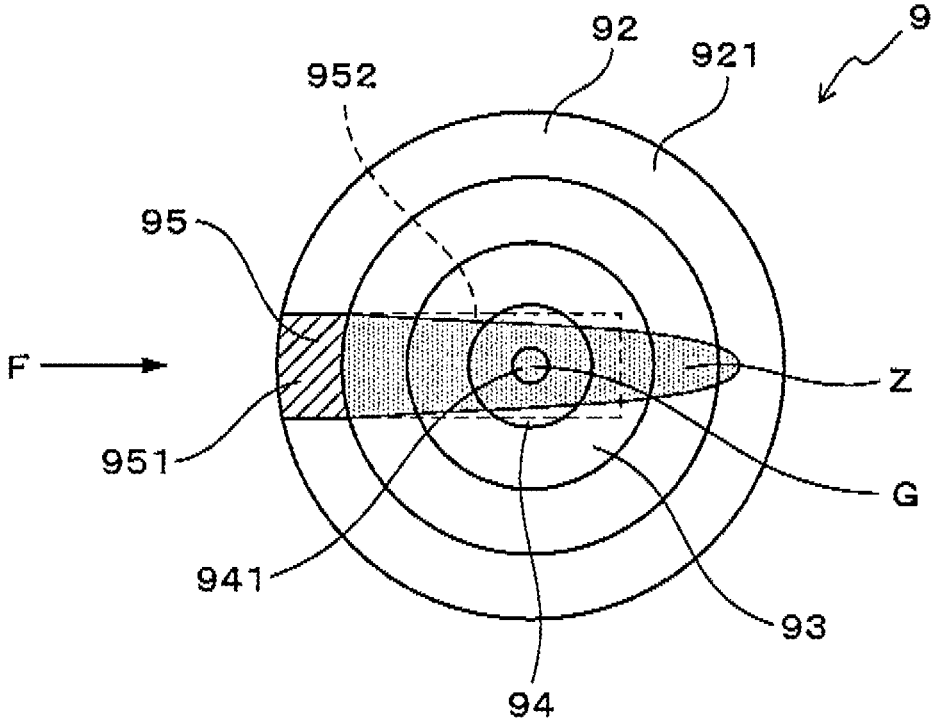
FIG. 14B is a cross-sectional view taken along the line XIV-XIV of FIG. 14A.

This may be because, as shown in FIGS. 14A and 14B, when the vertical portion 951 of the spark plug 9 is located upstream of the airflow F with reference to the spark discharge gap G, the airflow F is fully blocked by the vertical portion 951 and the airflow F in the vicinity of the spark discharge gap G is stagnated. More specifically, when the spark discharge gap G is included in an area that is a stagnation area of the airflow F shown by reference Z in FIGS. 14A and 14B, the discharge spark S is unlikely to be extended and a sufficient discharge length L (see FIG. 9) will no longer be obtained. As a result, it will be difficult for the spark plug 9 to exhibit stable ignition performance. In summary, as will be understood from FIG. 13, the ignition performance of the spark plug 9 of Comparative Example 1 significantly varies, depending on its mounting posture with respect to the internal combustion engine.

Further, as shown in FIG. 13, the polygonal line C2 indicating the A/F limit of the spark plug 90 of Comparative Example 2 shows minimization in the variation of the A/F limit attributed to the mounting angle β. Specifically, at the position where the mounting angle β is 0° (360°), the A/F limit is sufficiently high. This shows that the provision of the electrode-side baffle projection 22 can exert the guiding function when the vertical portion 951 of the ground electrode 95 is located upstream of the airflow F.

However, as will be understood from FIG. 13, when the mounting angle β is 180°, i.e. when the vertical portion 951 of the ground electrode 95 is located downstream of the airflow F, the A/F limit is small, which is at a level similar to Comparative Example 1. This may be because the airflow that passes through the spark discharge gap G collides against the vertical portion 951 of the ground electrode 95 to tend to weaken the force of the airflow passing through the spark discharge gap G, and the discharge spark S is unlikely to be extended to a large extent.

In this regard, as shown in FIG. 13, the polygonal line C3 indicating the A/F limit of the spark plug 1 of the first embodiment shows that the A/F limit is improved at a position where the mounting angle β is 0° (360°) and 180° as well. This means that the spark plug 1 is able to ensure sufficient ignitability irrespective of its mounting posture. Therefore, it will be seen that the spark plug 1 of the first embodiment is able to ensure sufficient ignitability irrespective of its mounting posture.

(Second Embodiment)

Figure 15:
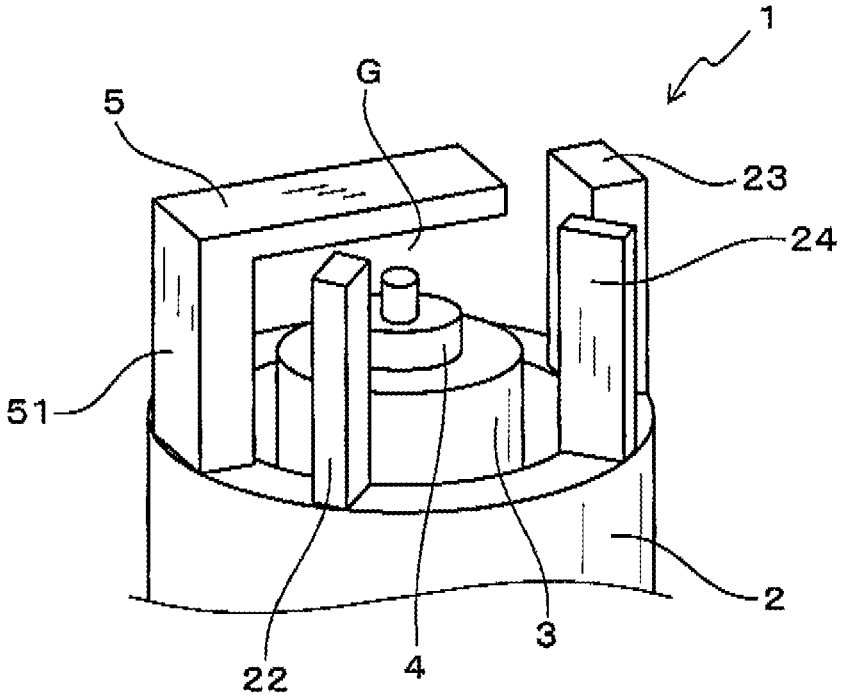
FIG. 15 is a perspective view illustrating a top end portion of a spark plug, according to a second embodiment of the present invention.
Figure 16:
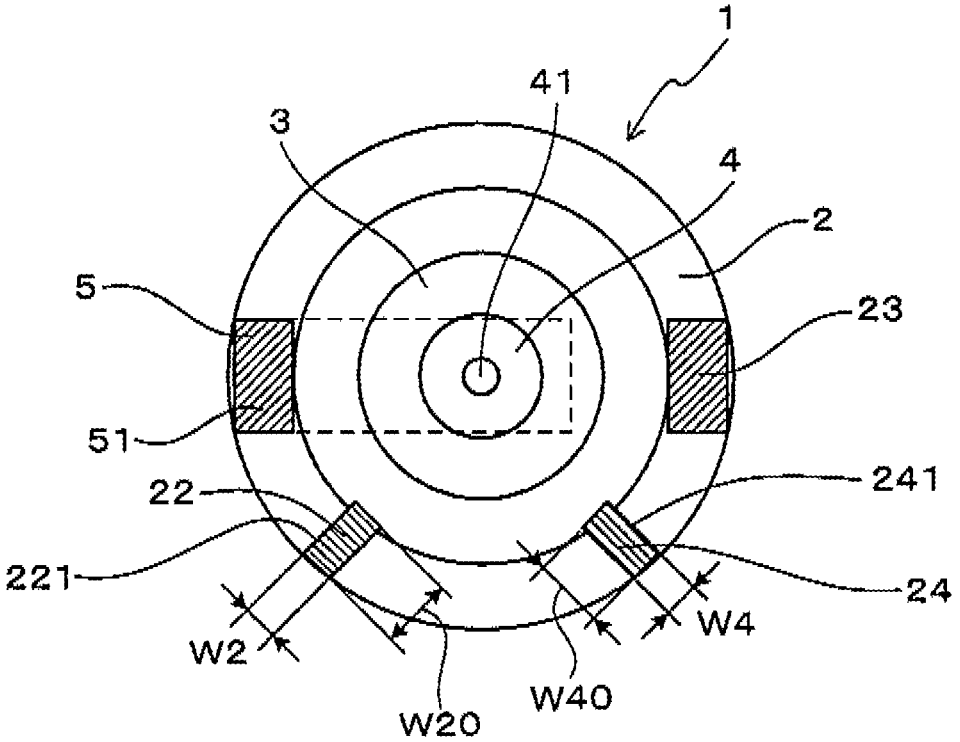
FIG. 16 is a cross-sectional view illustrating the spark plug, taken at a position in a spark discharge gap in a plane perpendicular to the axial direction, according to the second embodiment.

Referring to FIGS. 15 and 16, hereinafter is described a second embodiment of the present invention. In the second and the subsequent embodiments, the components identical with or similar to those in the first embodiment are given the same reference numerals for the sake of omitting unnecessary explanation.

As shown in FIGS. 15 and 16, the spark plug 1 of the second embodiment includes the electrode-side baffle projection 22 and the opposite-side baffle projection 24, which are both formed into a quadratic prism.

The electrode-side and opposite-side baffle projections 22 and 24 have cross sections at a position axially nearest to the spark discharge gap G, in which radial widths W20 and W40 are larger than the circumferential widths W2 and W4, respectively, the cross sections being perpendicular to the axial direction. In the present embodiment, similar to the first embodiment, the electrode-side and opposite-side baffle projections 22 and 24 have top ends which are positioned on the tip-end side, i.e. positioned at a level higher than the opposing surface 53 of the opposing portion 52 of the ground electrode 5, the opposing surface 53 being opposed to the spark discharge gap G. Thus, at the same axial position in the spark discharge gap G, these projections 22 and 24 have cross-sectional shapes in which the radial widths W20 and W40 are larger than the circumferential widths W2 and W4, respectively.

The rest of the configuration is similar to the first embodiment.

In the present embodiment, the airflow directed to the vicinity of the top end portion of the spark plug 1 from the upstream is efficiently and easily directed to the spark discharge gap G by the electrode-side or opposite-side baffle projection 22 or 24. In addition, the electrode-side or opposite-side baffle projection 22 or 24 is unlikely to block the airflow directed to the vicinity of the top end portion of the spark plug 1 from the upstream. Specifically, in a state where the ground electrode 5 or the opposite projection 23 is located upstream of the spark discharge gap G, the electrode-side or opposite-side baffle projection 22 or 24 is permitted to function directing the airflow to the spark discharge gap G (guiding function). However, when the electrode-side or opposite-side baffle projection 22 or 24 is located upstream of the spark discharge gap G, the projection 22 or 24 may block the airflow directed to the spark discharge gap G, depending on the shape of the projection 22 or 24. The guiding function will be more easily exerted as the radial width W20 or W40 of the electrode-side or opposite-side baffle projection 22 or 24 becomes larger. The effect of blocking the airflow directed to the spark discharge gap G will be more easily exerted as the circumferential width W2 or W4 of the electrode-side or opposite-side baffle projection 22 or 24 becomes larger.

Therefore, in the shapes of the electrode-side and opposite-side baffle projections 22 and 24, the radial widths W20 and W40 are made larger than the circumferential widths W2 and W4, respectively. Thus, the airflow directed to the spark discharge gap G is prevented from being blocked, and the airflow is efficiently and easily directed to the spark discharge gap G.

The rest of the advantageous effects are similar to those of the first embodiment.

(Third Embodiment)

Figure 17:
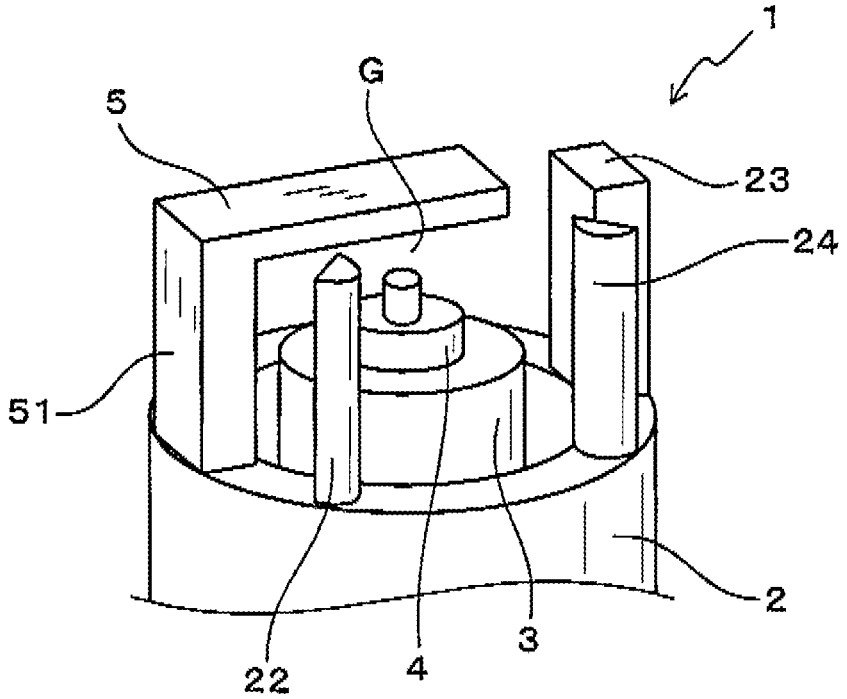
FIG. 17 is a perspective view illustrating a top end portion of a spark plug, according to a third embodiment of the present invention.
Figure 18:
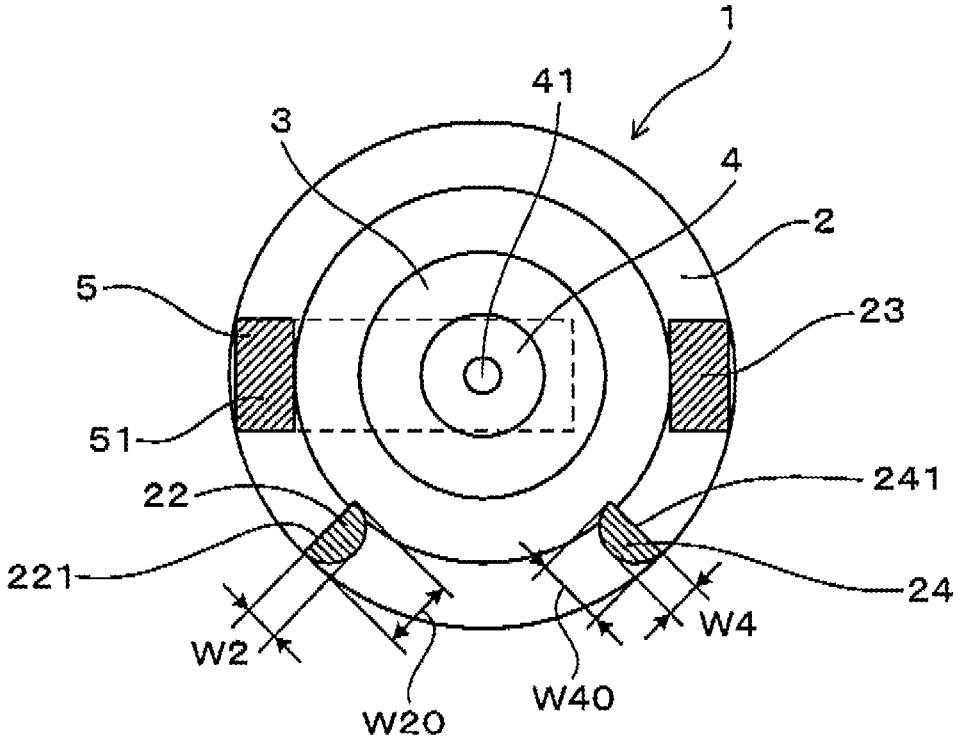
FIG. 18 is a cross-sectional view illustrating the spark plug, taken at a position in a spark discharge gap along a plane perpendicular to the axial direction, according to the third embodiment.

Referring to FIGS. 17 and 18, a third embodiment of the present invention is described. As shown in FIGS. 17 and 18, the spark plug 1 of the third embodiment includes the electrode-side and opposite-side baffle projections 22 and 24 each having a substantially semi-circular cross section in a plane perpendicular to the axial direction. In other words, the electrode-side and opposite side baffle projections 22 and 24 are each formed into a substantially semi-circular prism.

Further, the electrode-side and opposite-side baffle projections 22 and 24 have respective planar portions in the electrode-side and opposite-side baffle surfaces 221 and 241, respectively, and also have respective curved portions on the other side of the planar portions. In the electrode-side and opposite side baffle projections 22 and 24, the radial widths W20 and W40 are larger than the circumferential widths W2 and W4.

The rest of the configuration is similar to the first embodiment.

The present embodiment as well can provide a spark plug for an internal combustion engine having a simple configuration, which is able to ensure stable ignitability, irrespective of the mounting posture of the spark plug with respect to the internal combustion engine.

(Fourth Embodiment)

Figure 19:
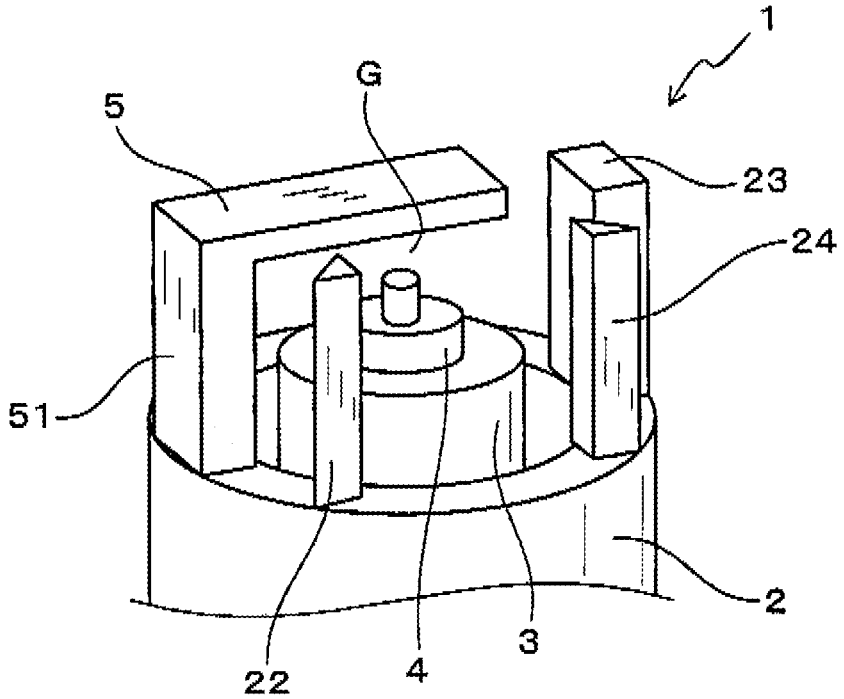
FIG. 19 is a perspective view illustrating a top end portion of a spark plug, according to a fourth embodiment of the present invention.
Figure 20:
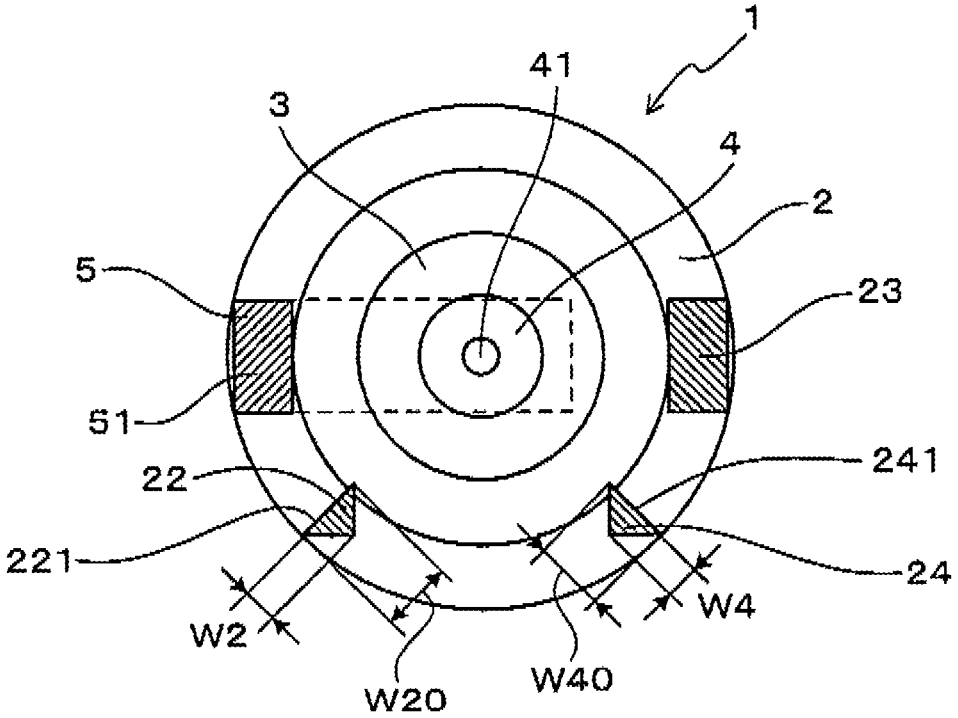
FIG. 20 is a cross-sectional view illustrating the spark plug, taken at a position in a spark discharge gap along a plane perpendicular to the axial direction, according to the fourth embodiment.

Referring to FIGS. 19 and 20, hereinafter is described a fourth embodiment of the present invention. As shown in FIGS. 19 and 20, the spark plug 1 according to the fourth embodiment includes the electrode-side and opposite-side baffle projections 22 and 24 each having a triangular cross section in a plane perpendicular to the axial direction. In other words, the electrode-side and opposite-side baffle projections 22 and 24 are each formed into a triangular prism.

However, the electrode-side and opposite-side baffle projections 22 and 24 are each in a shape of an isosceles triangle, in which one side is longer than the remaining two sides. The base (longest side) of the isosceles triangle is permitted to reside in the electrode-side baffle surface 221 or the opposite-side baffle surface 241. The electrode-side and opposite-side baffle projections 22 and 24 have the radial widths W20 and W40 which are larger than the circumferential widths W2 and W4, respectively.

The rest of the configuration is similar to the first embodiment.

The present embodiment as well can provide a spark plug for an internal combustion engine having a simple configuration, which is able to ensure stable ignitability, irrespective of the mounting posture of the spark plug with respect to the internal combustion engine.

(Fifth Embodiment)

Figure 21:
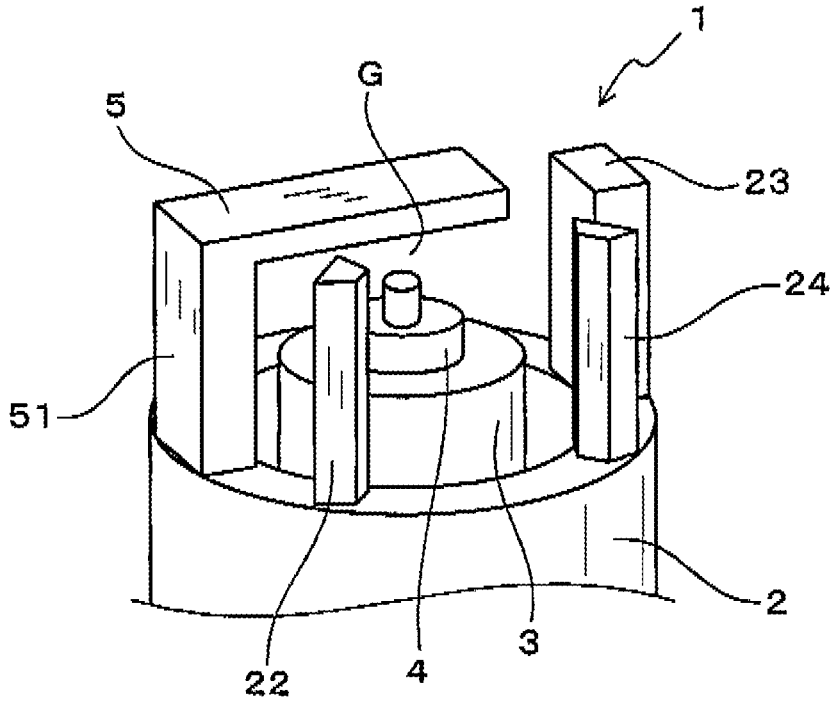
FIG. 21 is a perspective view illustrating a top end portion of a spark plug, according to a fifth embodiment of the present invention.
Figure 22:
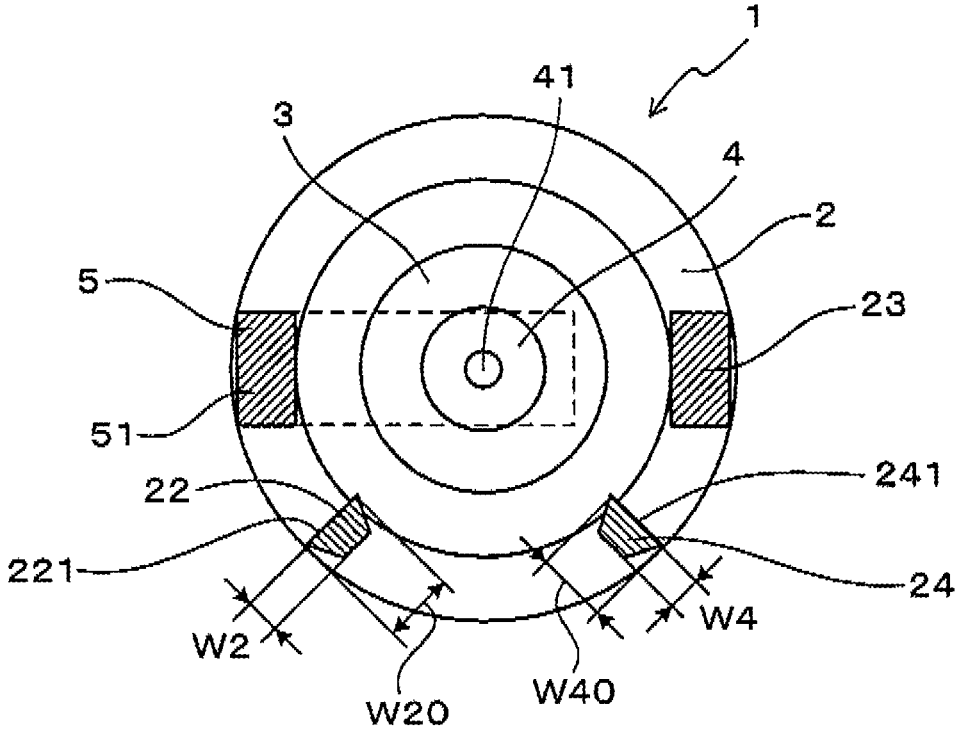
FIG. 22 is a cross-sectional view illustrating the spark plug, taken at a position in a spark discharge gap along a plane perpendicular to the axial direction, according to the fifth embodiment.

Referring to FIGS. 21 and 22, hereinafter is described a fifth embodiment of the present invention. As shown in FIGS. 21 and 22, the spark plug 1 according to the fifth embodiment includes the electrode-side and opposite-side baffle projections 22 and 24 each having a trapezoidal cross section in a plane perpendicular to the axial direction.

The electrode-side or opposite-side baffle projection 22 or 24 has one side that is permitted to reside in the electrode-side or opposite-side baffle surface 221 or 241. In the present embodiment, of the two bases that are parallel to each other in the trapezoidal cross section, the longer one is permitted to reside in the electrode-side or opposite-side baffle surface 221 or 241. Further, the electrode-side and opposite-side baffle projections 22 and 24 have radial widths W20 and W40 that are larger than the circumferential widths W2 and W4, respectively.

The rest of the configuration is similar to the first embodiment.

The present embodiment as well can provide a spark plug for an internal combustion engine having a simple configuration, which is able to ensure stable ignitability, irrespective of the mounting posture of the spark plug with respect to the internal combustion engine.

(Sixth Embodiment)

Figure 23:
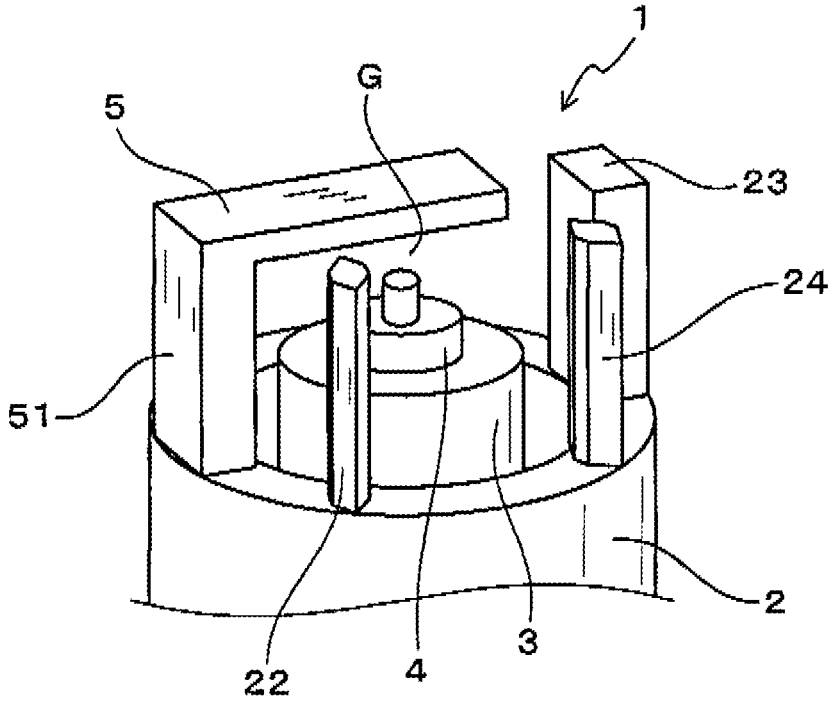
FIG. 23 is a perspective view illustrating a top end portion of a spark plug, according to a sixth embodiment of the present invention.
Figure 24:
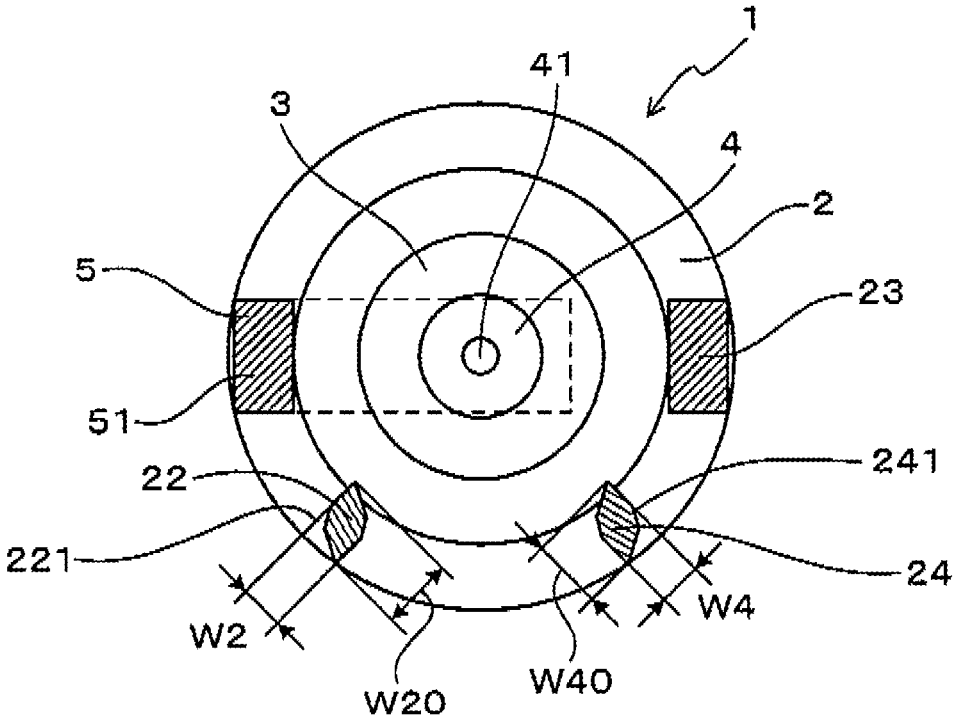
FIG. 24 is a cross-sectional view illustrating the spark plug, taken at a position in a spark discharge gap along a plane perpendicular to the axial direction, according to the sixth embodiment.

Referring to FIGS. 23 and 24, a sixth embodiment of the present invention is described. As shown in FIGS. 23 and 24, the spark plug 1 according to the sixth embodiment includes the electrode-side and opposite-side baffle projections 22 and 24 each having a hexagonal cross section in a plane perpendicular to the axial direction.

The electrode-side or opposite-side baffle projection 22 or 24 has one side in the hexagonal cross section, which is permitted to reside in the electrode-side or opposite-side baffle surface 221 or 241. Further, one side configuring the electrode-side or opposite-side baffle surface is located near the spark discharge gap G with reference to the radial direction. Further, the electrode-side and opposite-side baffle projections 22 and 24 have radial widths W20 and W40 that are larger than the circumferential widths W2 and W4, respectively.

The rest of the configuration is similar to the first embodiment.

The present embodiment as well can provide a spark plug for an internal combustion engine having a simple configuration, which is able to ensure stable ignitability, irrespective of the mounting posture of the spark plug with respect to the internal combustion engine.

(Seventh Embodiment)

Figure 25:
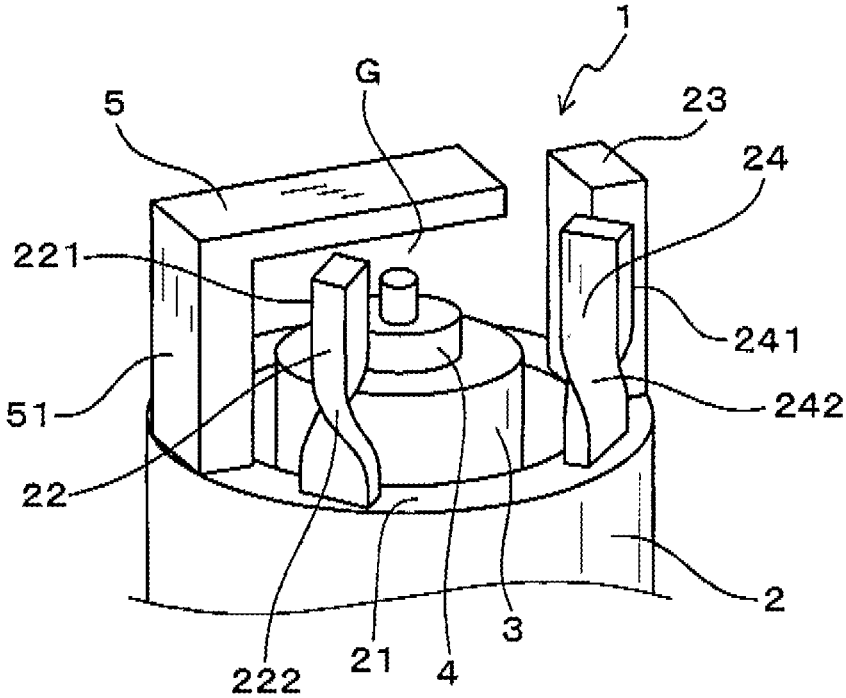
FIG. 25 is a perspective view illustrating a top end portion of a spark plug, according to a seventh embodiment of the present invention.
Figure 26:
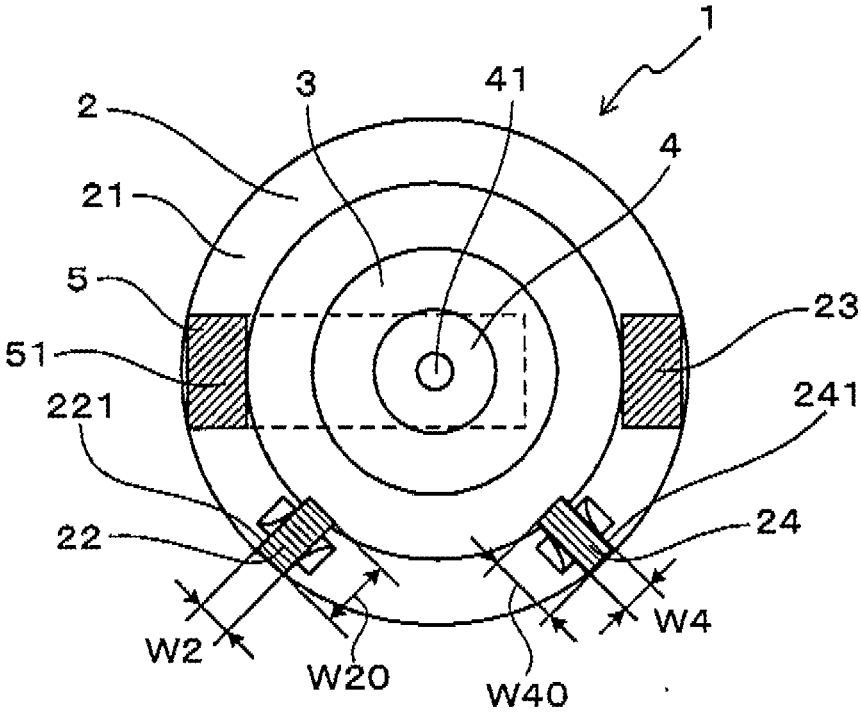
FIG. 26 is a cross-sectional view illustrating the spark plug, taken at a position in a spark discharge gap along a plane perpendicular to the axial direction, according to the seventh embodiment.
Figure 27:
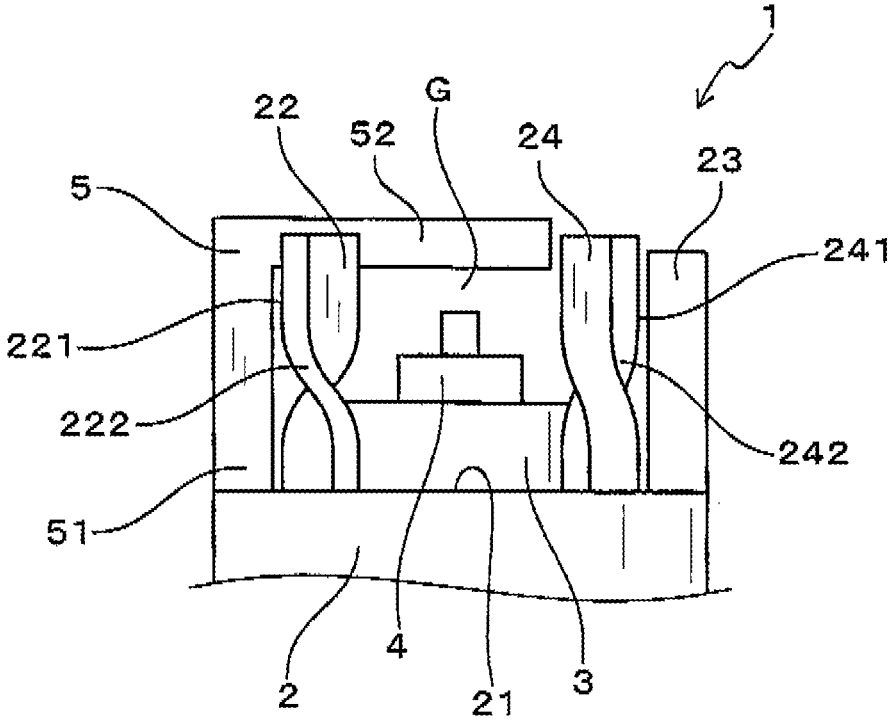
FIG. 27 is a side view illustrating the top end portion of the spark plug, according to the seventh embodiment.

Referring to FIGS. 25 to 27, a seventh embodiment of the present invention is described. As shown in FIGS. 25 to 27, the spark plug 1 according to the seventh embodiment includes the electrode-side and opposite side baffle projections 22 and 24 that have twisted portions 222 and 242, respectively.

Specifically, the electrode-side or opposite side baffle projection 22 or 24 has the twisted portion 222 or 242 between a base end portion of the projection, which is joined to the top end portion 21 of the housing 2, and some portion in the electrode-side or opposite-side baffle surface 221 or 241. The electrode-side or opposite-side baffle projection 22 or 24 has a shape that is obtained by circumferentially twisting, by 90°, a quadratic prism having a rectangular cross section perpendicular to the axial direction, about its center axis at the twisted portion 222 or 242.

The electrode-side and opposite-side baffle surfaces 221 and 241 are formed on the tip-end side with reference to the twisted portions 222 and 242, respectively. It is preferable that the twisted portions 222 and 242 are formed on the base-end side with reference to the spark discharge gap G. Thus, the electrode-side and opposite-side baffle surfaces 221 and 241 are formed, axially covering the entire spark discharge gap G. Further, it is more preferable that the twisted portions 222 and 242 are formed on the base-end side with reference to the top end of the insulation porcelain 3.

The electrode-side and opposite-side baffle projections 22 and 24 have cross sections in which the radial widths W20 and W40 are larger than the circumferential widths W2 and W4, respectively, the cross sections being taken at an axial position nearest to the spark discharge gap G. In the present embodiment, the foregoing cross sections of the electrode-side and opposite-side baffle projections 22 and 24 are taken at the same axial position in the spark discharge gap G. In these cross sections, relations W20>W2 and W40>W4 are established. In other words, the relations W20>W2 and W40>W4 are established in the portions of the electrode-side and opposite-side baffle projections 22 and 24, the portions including the electrode-side and opposite-side baffle surfaces 221 and 241, respectively.

Further, the portions of the electrode-side and opposite-side baffle projections 22 and 24, in which the electrode-side and opposite-side baffle surfaces 221 and 241 are formed, respectively, are protruded inward with reference to the inner peripheral surface of the top end portion 21 of the housing 2, but are not protruded outward with reference to the outer peripheral surface of the top end portion 21 of the housing 2. On the base-end side with reference to the twisted portions 222 and 242, the circumferential widths of the electrode-side and opposite-side baffle projections 22 and 24, respectively, are larger than the radial widths thereof.

The rest of the configuration is similar to the first embodiment.

In the present embodiment, on the base-end side with reference to the twisted portions 222 and 242, the circumferential widths of the electrode-side and opposite-side baffle projections 22 and 24, respectively, are larger than the radial widths thereof. Accordingly, the electrode-side and opposite-side baffle projections 22 and 24 are joined to the top end portion 21 of the housing 2 via large joint surfaces. Therefore, with respect to the housing 2, joint strength of the electrode-side and opposite-side baffle projections 22 and 24 is enhanced.

On the other hand, the portions of the electrode-side and opposite-side baffle projections 22 and 24, in which the electrode-side and opposite-side baffle surfaces 221 and 241 are formed, respectively, have the radial widths W20 and W40 which are larger than the circumferential widths W2 and W4. Accordingly, the electrode-side and opposite-side baffle surfaces 221 and 241 are each ensured to have a large area to thereby enhance the guiding function.

The rest of the configuration is similar to the first embodiment.

(Eighth Embodiment)

Figure 28:
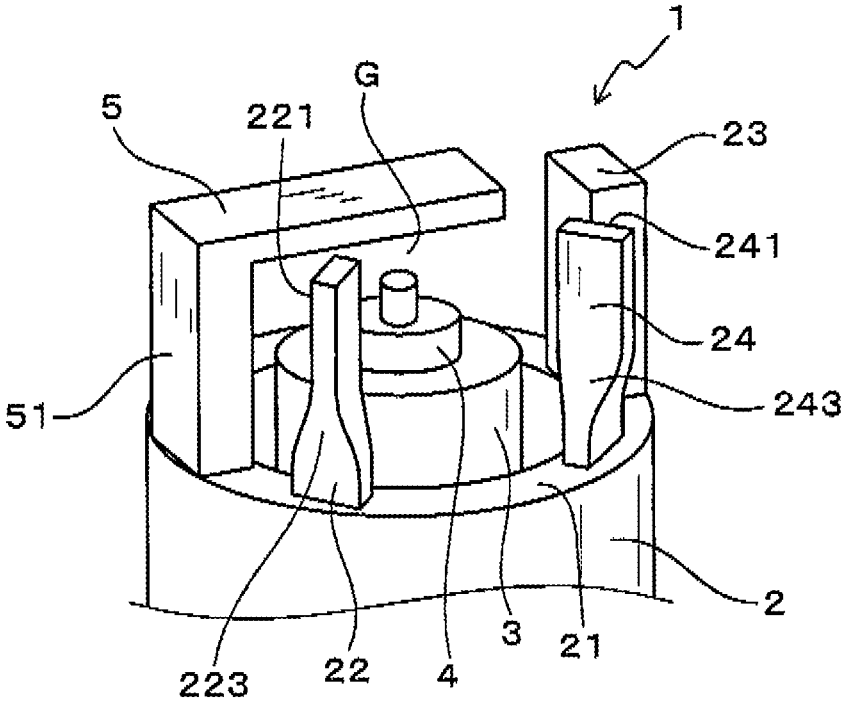
FIG. 28 is a perspective view illustrating a top end portion of a spark plug, according to an eighth embodiment of the present invention.
Figure 29:
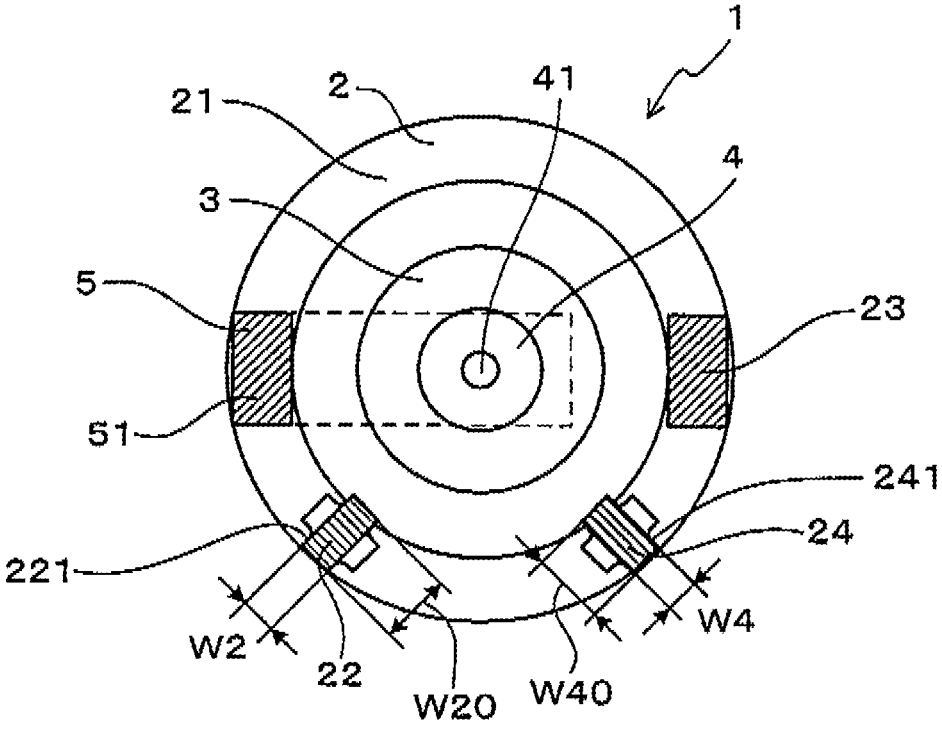
FIG. 29 is a cross-sectional view illustrating the spark plug, taken at a position in a spark discharge gap along a plane perpendicular to the axial direction, according to the eighth embodiment.
Figure 30:
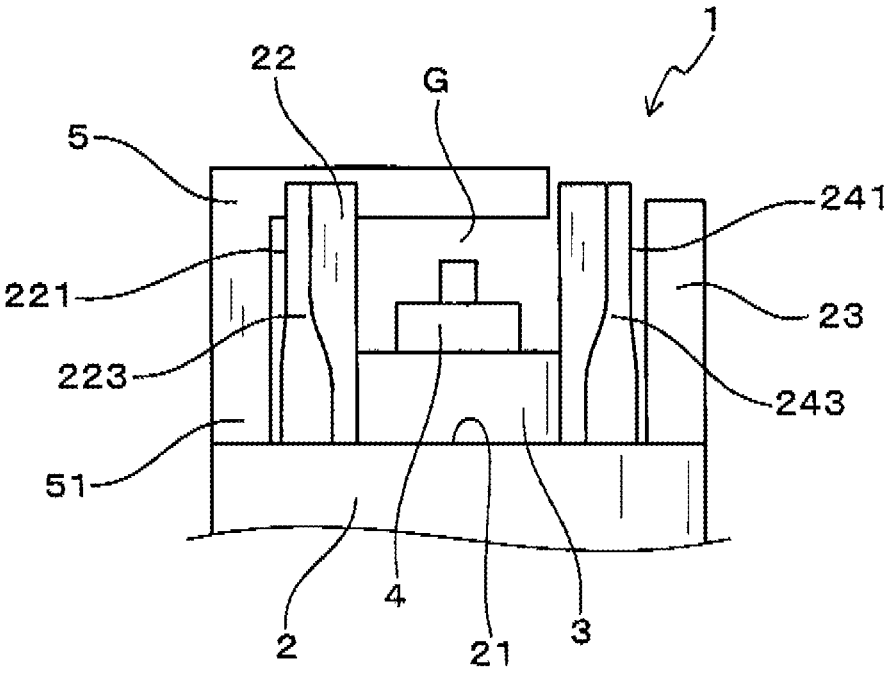
FIG. 30 is a side view of the top end portion of the spark plug, according to the eighth embodiment.

Referring to FIGS. 28 to 30, an eighth embodiment of the present invention is described. As shown in FIGS. 28 to 30, the spark plug 1 according to the eighth embodiment includes the electrode-side and opposite-side baffle projections 22 and 24 which are provided with gradually-changing portions 223 and 243, respectively. In each of the gradually-changing portions 223 and 243, the cross section in a plane perpendicular to the axial direction gradually changes its shape along the axial direction.

Specifically, the electrode-side or opposite-side baffle projection 22 or 24 has the gradually-changing portion 223 or 243 that is located between a base end portion through which the projection is joined to the top end portion 21 of the housing 2, and a portion that configures the electrode-side or opposite-side baffle surface 221 or 241. In the electrode-side or opposite-side baffle projection 22 or 24, the cross section in the base end portion and the cross section in the portion that configures the electrode-side or opposite-side baffle surface 221 or 241, are both in a rectangular shape. However, the longitudinal direction of the former rectangular cross section is deviated by about 90° from the longitudinal direction of the latter rectangular cross section.

The electrode-side and opposite-side baffle surfaces 221 and 241 are formed on the tip-end side with reference to the gradually-changing portions 223 and 243, respectively. It is preferable that the gradually-changing portions 223 and 243 are formed on the base end side with reference to the spark discharge gap G. Thus, the electrode-side and opposite-side baffle surfaces 221 and 241 are formed axially covering the entire spark discharge gap G. It is more preferable that the gradually-changing portions 223 and 243 are formed on the base-end side with reference to the top end of the insulation porcelain 3.

In the cross sections of the electrode-side and opposite-side baffle projections 22 and 24 in a plane perpendicular to the axial direction at a position axially nearest to the spark discharge gap G, the radial widths W20 and W40 are larger than the circumferential widths W2 and W4, respectively. In the present embodiment, the foregoing cross sections of the electrode-side and opposite-side baffle projections 22 and 24 are taken at the same axial position in the spark discharge gap G. In the cross sections, relations W20>W2 and W40>W4 are established. Specifically, in the portions of the electrode-side and opposite-side baffle projections 22 and 24, in which the electrode-side and opposite-side baffle surfaces 221 and 241 are formed, respectively, the relations W20>W2 and W40>W4 are established.

The portions of the electrode-side and opposite-side baffle projections 22 and 24, in which the electrode-side and opposite-side baffle surfaces 221 and 241 are formed, respectively, are protruded inward with reference to the inner peripheral surface of the top end portion 21 of the housing 2, but are not protruded outward with reference to the inner peripheral surface of the top end portion 21 of the housing 2. On the base-end side with reference to the gradually-changing portions 223 and 243, the circumferential widths are larger than the radial widths.

The rest of the configuration is similar to the first embodiment.

In the present embodiment, the portions of the electrode-side and opposite-side baffle projections 22 and 24, which are located on the base-end side with reference to the gradually-changing portions 223 and 243, respectively, have circumferential widths which are larger than the radial widths. Accordingly, the electrode-side and opposite-side baffle projections 22 and 24 are joined to the top end portion 21 of the housing 2 via large joint surfaces. Therefore, with respect to the housing 2, joint strength of the electrode-side and opposite-side baffle projections 22 and 24 is enhanced.

On the other hand, the portions of the electrode-side and opposite-side baffle projections 22 and 24, in which the electrode-side and opposite-side baffle surfaces 221 and 241 are formed, respectively, have the radial widths W20 and W40 which are larger than the circumferential widths W2 and W4. Accordingly, the electrode-side and apposite-side baffle surfaces 221 and 241 are each ensured to have a large area to thereby enhance the guiding function.

The rest of the configuration is similar to the first embodiment.

The shapes of the electrode-side baffle projection 22, the opposite-side baffle projection 24 and the opposite projection 23 are not limited to the ones shown in the first to eighth embodiments but may be in various shapes.

Further, at least one of the electrode-side baffle projection 22, the opposite-side baffle projection 24 and the opposite projection 23 may have a top end which is located on the base-end side with reference to the spark discharge gap G, as far as the functions of the projections can be exerted. In this case, the "position axially nearest to the spark discharge gap G" corresponds to the position of the top end of each of the electrode-side baffle projection 22, the opposite-side baffle projection 24 and the opposite projection 23.

In the first to eighth embodiments described above, the electrode-side and opposite-side baffle projections are formed being concentrated in one circumferential area between the ground electrode and the opposite projection. Alternatively to this, the electrode-side and opposite-side baffle projections may be arranged being scattered in both of the circumferential areas. In other words, the electrode-side and opposite-side baffle projections may be arranged in mutually different circumferential areas. In this case, as long as the electrode-side and opposite-side baffle projections are arranged so as not to face each other with the interposition of the center electrode, the advantageous effects similar to those of the first to eighth embodiments may be enjoyed.

What is claimed is:

1. A spark plug for internal combustion engines, comprising:

a cylindrical housing formed to have a top end portion, wherein the housing has a length-wise direction defined as an axial direction, a circumferential direction, a radial direction, and the housing has a tip-end side and a base-end side in the axial direction;

a cylindrical insulation porcelain held inside the housing;

a center electrode formed to have a top end portion and held inside the insulation porcelain such that the top end portion protrudes from the insulation porcelain;

a ground electrode which protrudes from the top end portion of the housing such that there is left a spark discharge gap between the ground electrode and the center electrode;

a first projection which projects from a first position on the top end portion of the housing to the tip-end side, the first position being set to be opposed to the ground electrode with the center electrode therebetween, a second projection which projects from a second position on the top end portion of the housing to the tip-end side, the second position being closer to the ground electrode than to the first projection, and a third projection which projects from a third position on the top end portion of the housing to the tip-end side, the third position being closer to the first projection than to the ground electrode, wherein the second and third projections have widths in the circumferential direction, wherein the widths are smaller than a width of the ground electrode in the circumferential direction at positions of the second and third projections, the positions of the second and third projections being the closest to the spark discharge gap in the axial direction.

2. The spark plug of claim 1, wherein the second and third projections are located only within half of an area of the top end portion of the housing, the half of the area being half of an axial side area of the top end portion divided by a virtual line passing the ground electrode and the first projection.

3. The spark plug of claim 2, wherein the axial side area of the top end portion is an annular area of an axial side of the housing.

4. The spark plug of claim 1, wherein the second and third projections have tops whose protrusion heights from the top end portion are equal to or lower than a top of the ground electrode and are equal to or higher than a top of the insulation porcelain in the axial direction.

5. The spark plug of claim 1, wherein the first projection has a top whose protrusion height from the top end portion is equal to or lower than a top of the ground electrode and is equal to or higher than a top of the insulation porcelain in the axial direction.

6. The spark plug of claim 1, wherein the first, second and third projections are protruded parallel with each other from the top end portion in the axial direction.

7. The spark plug of claim 1, wherein the second and third projections have cross sections at positions thereof which are the closest to the spark discharge gap in the axial direction, wherein each of the cross sections has a width in the radial direction which is larger than a width in the circumferential directions.

8. The spark plug of claim 1, wherein the second and third projections have cross sections at positions thereof which are the closest to the spark discharge gap in the axial direction, wherein each of the cross sections is triangular.

9. The spark plug of claim 2, wherein the second and third projections have tops whose protrusion heights from the top end portion are equal to or lower than a top of the ground electrode and are equal to or higher than a top of the insulation porcelain in the axial direction.

10. The spark plug of claim 2, wherein the first projection has a top whose protrusion height from the top end portion is equal to or lower than a top of the ground electrode and is equal to or higher than a top of the insulation porcelain in the axial direction.

11. The spark plug of claim 2, wherein the second and third projections have widths in the circumferential direction, wherein the widths are smaller than a width of the ground electrode in the circumferential direction at positions of the second and third projections, the positions of the second and third projections being the closest to the spark discharge gap in the axial direction.

12. The spark plug of claim 2, wherein the first, second and third projections are protruded parallel with each other from the top end portion in the axial direction.

13. The spark plug of claim 2, wherein the second and third projections have cross sections at positions thereof which are the closest to the spark discharge gap in the axial direction, wherein each of the cross sections has a width in the radial direction which is larger than a width in the circumferential directions.

14. The spark plug of claim 2, wherein the second and third projections have cross sections at positions thereof which are the closest to the spark discharge gap in the axial direction, wherein each of the cross sections is triangular.

15. The spark plug of claim 3, wherein the first projection has a top whose protrusion height from the top end portion is equal to or lower than a top of the ground electrode and is equal to or higher than a top of the insulation porcelain in the axial direction.

16. The spark plug of claim 15, wherein the second and third projections have widths in the circumferential direction, wherein the widths are smaller than a width of the ground electrode in the circumferential direction at positions of the second and third projections, the positions of the second and third projections being the closest to the spark discharge gap in the axial direction.

17. The spark plug of claim 16, wherein the first, second and third projections are protruded parallel with each other from the top end portion in the axial direction.

18. The spark plug of claim 17, wherein the second and third projections have cross sections at positions thereof which are the closest to the spark discharge gap in the axial direction, wherein each of the cross sections has a width in the radial direction which is larger than a width in the circumferential directions.

19. The spark plug of claim 18, wherein the second and third projections have cross sections at positions thereof which are the closest to the spark discharge gap in the axial direction, wherein each of the cross sections is triangular.

20. A spark plug for internal combustion engines, comprising:

a cylindrical housing formed to have a top end portion, wherein the housing has a length-wise direction defined as an axial direction, a circumferential direction, a radial direction, and the housing has a tip-end side and a base-end side in the axial direction;

a cylindrical insulation porcelain held inside the housing;

a center electrode formed to have a top end portion and held inside the insulation porcelain such that the top end portion protrudes from the insulation porcelain;

a ground electrode which protrudes from the top end portion of the housing such that there is left a spark discharge gap between the ground electrode and the center electrode;

a first projection which projects from a first position on the top end portion of the housing to the tip-end side, the first position being set to be opposed to the ground electrode with the center electrode therebetween, a second projection which projects from a second position on the top end portion of the housing to the tip-end side, the second position being closer to the ground electrode than to the first projection, and a third projection which projects from a third position on the top end portion of the housing to the tip-end side, the third position being closer to the first projection than to the ground electrode, wherein the second and third projections have cross sections at positions thereof which are the closest to the spark discharge gap in the axial direction, wherein each of the cross sections is triangular.

* * * * *